US011812776B2

(12) United States Patent
Carroll et al.

(10) Patent No.: US 11,812,776 B2
(45) **Date of Patent: *Nov. 14, 2023**

(54) METHODS AND MACHINES FOR POUCHING SMOKELESS TOBACCO AND TOBACCO SUBSTITUTE PRODUCTS

(71) Applicant: Altria Client Services LLC, Richmond, VA (US)

(72) Inventors: Andrew Nathan Carroll, Chester, VA (US); Shannon Maxwell Black, Richmond, VA (US); Yan Helen Sun, Midlothian, VA (US); William J. Burke, Nashville, TN (US); Christopher Joseph Dinovi, Ruther Glen, VA (US); David Phillips, Richmond, VA (US); Jason Andrew Macko, Richmond, VA (US); Robert Smith, Glen Allen, VA (US)

(73) Assignee: Altria Client Services LLC, Richmond, VA (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/693,607

(22) Filed: Mar. 14, 2022

(65) Prior Publication Data

US 2022/0202064 A1 Jun. 30, 2022

Related U.S. Application Data

(60) Continuation of application No. 16/919,617, filed on Jul. 2, 2020, now Pat. No. 11,284,643, which is a (Continued)

(51) Int. Cl.
*A24B 15/18* (2006.01)
*A24B 13/00* (2006.01)
(Continued)

(52) U.S. Cl.
CPC ..... *A24B 15/186* (2013.01); *A24B 13/00* (2013.01); *A24B 15/283* (2013.01); *D04H 13/00* (2013.01)

(58) Field of Classification Search
CPC ..... A24B 15/186; A24B 13/00; A24B 15/283; D04H 13/00
See application file for complete search history.

(56) References Cited

U.S. PATENT DOCUMENTS 2,580,609 A 1/1952 Schur et al.
2,734,509 A 2/1956 Jurgensen, Jr.
(Continued)

FOREIGN PATENT DOCUMENTS

DE 10346649 A1 5/2005
EP 2967124 A1 1/2016
(Continued)

OTHER PUBLICATIONS

Notice of Allowance for corresponding U.S. Appl. No. 17/030,606, dated Mar. 16, 2022 (8 pages).
(Continued)

*Primary Examiner* — Anthony Calandra
(74) *Attorney, Agent, or Firm* — Harness, Dickey & Pierce, P.L.C.

(57) ABSTRACT

A melt-blown fabric for pouching smokeless tobacco or a smokeless tobacco substitute can include melt-blown polymer fibers. The fabric can have a basis weight of less than 30 gsm and a tensile strength of at least 4 mJ in at least one predetermined direction. Method of making the fabric can include melt-blowing a polymeric material against a support surface and bonding the fibers or arranging them in a predetermined orientation. Pouched smokeless tobacco or tobacco substitute products including the fabrics provided herein can provide desirable flavor and tactile experience.

19 Claims, 20 Drawing Sheets

Related U.S. Application Data continuation of application No. 15/848,728, filed on Dec. 20, 2017, now Pat. No. 10,765,142, which is a division of application No. 14/212,826, filed on Mar. 14, 2014, now Pat. No. 10,028,521.

(60) Provisional application No. 61/786,315, filed on Mar. 15, 2013.

(51) Int. Cl.
*A24B 15/28* (2006.01)
*D04H 13/00* (2006.01)

(56) References Cited

U.S. PATENT DOCUMENTS

| | | | |
|---|---|---|---|
| 3,621,088 | A | 11/1971 | Hatcher et al. |
| 3,849,241 | A | 11/1974 | Butin et al. |
| 4,084,627 | A | 4/1978 | Focke et al. |
| 4,090,521 | A | 5/1978 | Elsner |
| 4,380,570 | A | 4/1983 | Schwarz |
| 4,516,590 | A | 5/1985 | Teng |
| 4,526,733 | A | 7/1985 | Lau |
| 4,528,993 | A | 7/1985 | Sensabaugh, Jr. et al. |
| 4,571,924 | A | 2/1986 | Bahrani |
| 4,607,479 | A | 8/1986 | Linden |
| 4,660,577 | A | 4/1987 | Sensabaugh et al. |
| 4,703,765 | A | 11/1987 | Paules et al. |
| 4,848,373 | A | 7/1989 | Lenkey |
| 4,987,907 | A | 1/1991 | Townend |
| 5,063,104 | A | 11/1991 | Robertson et al. |
| 5,146,955 | A | 9/1992 | Steiner et al. |
| 5,366,793 | A | 11/1994 | Fitts, Jr. et al. |
| 5,372,149 | A | 12/1994 | Roth et al. |
| 5,459,980 | A | 10/1995 | Kenney et al. |
| 5,476,616 | A | 12/1995 | Schwarz |
| 5,528,993 | A | 6/1996 | Vincelli |
| 5,645,790 | A | 7/1997 | Schwarz et al. |
| 6,013,223 | A | 1/2000 | Schwarz |
| 6,207,601 | B1 | 3/2001 | Maurer et al. |
| 6,455,030 | B2 | 9/2002 | Saito et al. |
| 6,716,498 | B2 | 4/2004 | Curro et al. |
| 7,156,937 | B2 | 1/2007 | Provost et al. |
| 7,231,752 | B2 | 6/2007 | Merken-Schiller et al. |
| 7,465,366 | B2 | 12/2008 | Provost et al. |
| 7,547,469 | B2 | 6/2009 | Provost et al. |
| 7,562,426 | B2 | 7/2009 | Barker et al. |
| 7,666,261 | B2 | 2/2010 | Bailey et al. |
| 7,718,556 | B2 | 5/2010 | Matsuda et al. |
| 7,810,507 | B2 | 10/2010 | Dube et al. |
| 8,377,215 | B2 | 2/2013 | Gee et al. |
| 8,747,562 | B2 | 6/2014 | Mishra et al. |
| 9,126,704 | B2 | 9/2015 | Williams |
| 9,370,204 | B2 | 6/2016 | Kawata et al. |
| 9,763,473 | B2 | 9/2017 | Carroll et al. |
| 9,888,712 | B2 | 2/2018 | Zimmermann |
| 10,028,521 | B2 | 7/2018 | Carroll et al. |
| 10,039,309 | B2 | 8/2018 | Carroll et al. |
| 10,258,076 | B2 | 4/2019 | Carroll et al. |
| 10,463,070 | B2 | 11/2019 | Carroll et al. |
| 11,284,643 | B2 | 3/2022 | Carroll et al. |
| 11,375,740 | B2 | 7/2022 | Carroll et al. |
| 2004/0038022 | A1 | 2/2004 | Maugans et al. |
| 2004/0118421 | A1 | 6/2004 | Hodin et al. |
| 2004/0118422 | A1 | 6/2004 | Lundin et al. |
| 2004/0209540 | A1 | 10/2004 | Schwarz |
| 2005/0056956 | A1 | 3/2005 | Zhao et al. |
| 2005/0092146 | A1 | 5/2005 | Carbone et al. |
| 2005/0178398 | A1 | 8/2005 | Breslin et al. |
| 2005/0196580 | A1 | 9/2005 | Provost et al. |
| 2005/0196583 | A1 | 9/2005 | Provost et al. |
| 2005/0217092 | A1 | 10/2005 | Barker et al. |
| 2005/0244521 | A1 | 11/2005 | Strickland et al. |
| 2006/0117712 | A1 | 6/2006 | Merken-Schiller et al. |
| 2006/0191548 | A1 | 8/2006 | Strickland et al. |
| 2006/0264130 | A1 | 11/2006 | Karles et al. |
| 2007/0261707 | A1 | 11/2007 | Winterson et al. |
| 2008/0209586 | A1 | 8/2008 | Nielsen et al. |
| 2008/0302682 | A1 | 12/2008 | Engstrom et al. |
| 2008/0305297 | A1 | 12/2008 | Barker et al. |
| 2008/0308115 | A1 | 12/2008 | Zimmermann |
| 2009/0133703 | A1 | 5/2009 | Strickland et al. |
| 2009/0203280 | A9 | 8/2009 | Provost et al. |
| 2009/0256277 | A1 | 10/2009 | Brown et al. |
| 2009/0258099 | A1 | 10/2009 | Brown et al. |
| 2009/0258562 | A1 | 10/2009 | Brown et al. |
| 2010/0018539 | A1 | 1/2010 | Brinkley et al. |
| 2010/0018882 | A1 | 1/2010 | St. Charles |
| 2010/0170522 | A1 | 7/2010 | Sun et al. |
| 2010/0242978 | A1 | 9/2010 | Fuisz |
| 2010/0300465 | A1 | 12/2010 | Zimmermann |
| 2011/0036364 | A1 | 2/2011 | Pienemann et al. |
| 2011/0083688 | A1 | 4/2011 | Mishra et al. |
| 2011/0100863 | A1 | 5/2011 | Luciano |
| 2011/0220130 | A1 | 9/2011 | Mua et al. |
| 2012/0024301 | A1 | 2/2012 | Carroll et al. |
| 2012/0031414 | A1 | 2/2012 | Atchley et al. |
| 2012/0031416 | A1 | 2/2012 | Atchley et al. |
| 2012/0055305 | A1 | 3/2012 | Betti |
| 2012/0103353 | A1 | 5/2012 | Sebastian et al. |
| 2012/0298124 | A1 | 11/2012 | Shikata et al. |
| 2013/0192392 | A1 | 8/2013 | Strunk et al. |
| 2014/0127960 | A1 | 5/2014 | Kim et al. |
| 2017/0326829 | A1 | 11/2017 | Garris et al. |
| 2018/0279665 | A1 | 10/2018 | Carroll et al. |
| 2018/0318167 | A1 | 11/2018 | Luciano, Jr. et al. |
| 2018/0338521 | A1 | 11/2018 | Carroll et al. |
| 2020/0324924 | A1* | 10/2020 | Nelson ..... B65B 29/00 |
| 2022/0322729 | A1 | 10/2022 | Carroll et al. |

FOREIGN PATENT DOCUMENTS

| | | | |
|---|---|---|---|
| EP | 2967125 | A2 | 1/2016 |
| GB | 2408252 | A | 5/2005 |
| JP | H04-91773 | A | 3/1992 |
| WO | WO-05/046363 | A2 | 5/2005 |
| WO | WO-2005/115180 | A1 | 12/2005 |
| WO | WO-2009/048522 | A1 | 4/2009 |
| WO | WO-2010/087921 | A1 | 8/2010 |
| WO | WO-2011/117751 | A2 | 9/2011 |

OTHER PUBLICATIONS

Office Action for corresponding European Application No. 14724206.9 dated Sep. 21, 2018.

Invitation to Pay Fees in International Application No. PCT/US2014/028584, dated Sep. 9, 2014, six pages.

Tso, Chapter 1 in Tobacco, Production, Chemistry and Technology, 1999, Davis & Nielsen, eds. Blackwell Publishing, Oxford.

Rydholm, Pulping Processes, Interscience Publishers, 1967, pp. 51-52.

International Preliminary Report on Patentability in International Application No. PCT/US2014/028584, dated Sep. 24, 2015, 15 pages.

International Search Report and Written Opinion in International Application No. PCT/US2014/028242, dated Jul. 15, 2014, 12 pages.

Office Action for corresponding European Application No. 14716185.5, dated Mar. 28, 2019, 7 pages.

Office Action for European Application No. 14716185.5, dated Apr. 20, 2017, 6 pages.

Office Action for corresponding U.S. Appl. No. 15/848,728 dated Dec. 12, 2019, 9 pages.

Office Action for corresponding U.S. Appl. No. 16/036,078 dated Sep. 24, 2018.

Office Action for U.S. Appl. No. 16/671,581, dated Jan. 16, 2020 (10 pages).

Office Action for Canadian Application No. 2,905,062, dated Jan. 31, 2020, 6 pages.

Office Action for corresponding Canadian Application No. 2,905,062, dated Jan. 31, 2020, 6 pages.

(56) References Cited

OTHER PUBLICATIONS

Office Action for U.S. Appl. No. 16/042,221 dated Mar. 4, 2020 (12 pages).
Notice of Allowance received in copending U.S. Appl. No. 15/848,728 dated Mar. 25, 2020 (10 pages).
Office Action for Canadian Application 2,907,187, dated Apr. 28, 2020, 5 pages.
Notice of Allowance received in copending U.S. Appl. No. 16/042,221 dated Jun. 24, 2020 (10 pages).
Office Action for corresponding European Application 14724206.9, dated Jul. 20, 2020 (4 pages).
Office Action for corresponding European Application 14716185.5 dated Oct. 26, 2020 (4 pages).
Office Action for corresponding Canadian Application 2,907,187 dated Jan. 27, 2021 (5 pages).
Office Action for corresponding U.S. Appl. No. 16/919,617 dated Jul. 28, 2021 (9 pages).
Office Action received in copending U.S. Appl. No. 16/919,617 dated Jul. 28, 2021 (9 pages).
Notice of Allowance received in corresponding U.S. Appl. No. 16/919,617, dated Nov. 24, 2021.
Office Action for corresponding U.S. Appl. No. 17/030,606 dated Nov. 23, 2021 (19 gages).
Extended European Search Report for EP Application 22201312.0 dated Mar. 1, 2023 (10 pages).
Canadian Office Action for CA Application 3152453 dated May 17, 2023 (4 pages).

* cited by examiner

METHODS AND MACHINES FOR POUCHING SMOKELESS TOBACCO AND TOBACCO SUBSTITUTE PRODUCTS

CROSS REFERENCE TO RELATED APPLICATIONS

This application is a continuation of U.S. application Ser. No. 16/919,617, filed Jul. 2, 2020, which is a continuation of U.S. application Ser. No. 15/848,728, filed Dec. 20, 2017, which is a divisional of U.S. application Ser. No. 14/212,826, filed Mar. 14, 2014, which claims the benefit of priority under 35 U.S.C. § 119(e) to U.S. Application No. 61/786,315 filed Mar. 15, 2013, the entire contents of each of which are incorporated herein by reference.

WORKING ENVIRONMENT

This disclosure generally relates to methods of pouching smokeless tobacco products and tobacco substitute products, machines for pouching products, pouch material, methods of making pouch material, and smokeless tobacco products including the pouch material provided herein.

Smokeless tobacco is tobacco that is placed in the mouth and not combusted. There are various types of smokeless tobacco including: chewing tobacco, moist smokeless tobacco, snus, and dry snuff. Chewing tobacco is coarsely divided tobacco leaf that is typically packaged in a large pouch-like package and used in a plug or twist. Moist smokeless tobacco is a moist, more finely divided tobacco that is provided in loose form or in pouch form and is typically packaged in round cans and used as a pinch or in a pouch placed between a cheek and gum of an adult tobacco consumer. Snus is a heat treated smokeless tobacco. Dry snuff is finely ground tobacco that is placed in the mouth or used nasally.

Smokeless tobacco can be pouched in a fabric using a pouching machine. In some cases, a method for pouching smokeless tobacco includes flavoring the smokeless tobacco, pouching the flavored smokeless tobacco into a paper or fabric, and then packaging the pouches for delivery to consumers. A conventional pouching machine may form a supply of pouching material around tube, seal the edges of the pouching material to form a tube of pouching material, form a cross-seal to form a bottom of the pouch, deliver an amount of smokeless tobacco through the tube and into the bottom-sealed pouch, move the bottom-sealed pouch off the tube, and form a second cross-seal above the smokeless tobacco to close the pouch. The second-cross-seal can also be used as the bottom seal for a subsequent pouch as the process continues. Individual pouches can be cut at the cross-seals. A conventional pouching machine can rely upon a non-elastic pouching paper in order to properly meter an amount of tobacco in each pouch, which can result in a rigid and stiff pouched product, such as shown in FIG. 20. A convention pouching material can rely upon chemical treatment in order to manufacture the paper and permit a heat seal.

SUMMARY

Methods and machines provided herein are adapted to provide pouched smokeless tobacco products that can retain the smokeless tobacco material contained within the pouch, but provide an adult tobacco consumer with desirable flavor and tactile experience. In some cases, methods and machines provided herein can be used to pouch a tobacco substitute.

In some cases, methods and machines provided herein can seal smokeless tobacco or a similar material in an elastic material (e.g., polyurethane), which can result in a more moldable pouched product having a comfortable mouth feel. In some cases, pouching materials used in methods and machines provided herein can be heat sealed and cut in a single step, without a need for chemical binders, thus eliminating a need to have a large heat seal area, which can decrease mouth comfort. In some cases, an elastomeric polymer pouch provided herein can provide the unique property of allowing an adult tobacco consumer to reduce or increase a packing density of the elastomeric polymer pouch during use, which can impact a rate of flavor release. A higher packing density can reduce a rate of flavor release. In some cases, pouching materials used in methods and machines provided herein can be hydrophilic, which can provide a moist appearance and/or provide superior flavor release. In some cases, methods and machines provided herein can produce a pouched smokeless tobacco/tobacco substitute product using a low basis weight web of polymeric fibers, which can be more permeable to flavor release. Methods and machines provided herein can efficiently and accurately produce a plurality of pouched smokeless tobacco products, pouched tobacco substitute products, and/or other pouched products.

Pouched smokeless tobacco products provided herein can, in some cases, include an elastomeric polymer pouch material having a basis weight of less than 30 gsm. Pouched smokeless tobacco products provided herein can, in some cases, include a web of polymeric fibers having a basis weight of less than 30 gsm. In some cases, pouched smokeless tobacco products provided herein can include a web of polymeric fibers having a basis weight of less than 10 gsm. Pouched smokeless tobacco products provided herein can, in some cases, include a web of polymeric fibers having a basis weight of less than 5 gsm. The smokeless tobacco can be a dry or moist smokeless tobacco. In some cases, the smokeless tobacco is moist smokeless tobacco having has an oven volatile content of about 4% by weight to about 61% by weight. In some cases, the smokeless tobacco includes flavorants and/or other additives. Further, some systems include a container that retains a plurality of pouched smokeless tobacco products.

Elastomeric polymeric material (e.g., polypropylene, polyurethane, styrene, or a combination thereof) can be melt-blown, electro spun, or centrifugally force spun and sealed around a mixture including smokeless tobacco, a tobacco substitute, or a similar material. In some cases, polymeric fibers of elastomeric polymeric material are applied to a support surface and a resulting fabric can be collected for a subsequent pouch forming process. In some cases, polymeric fibers of elastomeric polymeric material are applied to a support surface and tobacco and/or a tobacco substitute pouched against the support surface. In some cases, polymeric fibers of elastomeric polymeric material can be melt-blown, electro spun, or centrifugally force spun directly against a mixture including smokeless tobacco and/or a tobacco substitute. In some cases, methods and machines provided herein can use a polymer spray head to melt-blow, electro spin, or centrifugally force spin a plurality of polymeric fibers to create a polymer deposition zone. In some cases, non-elastomeric polymer webs can be formed using machines and/or methods provided herein. In some cases, polymeric material can be formed into a yarn and knit into a polymer substrate for sealing around a smokeless tobacco (or a similar material). In some cases, polymeric yarn can be knit into a tubular member, smokeless tobacco inserted into the knit polymeric tubular member, and the knit polymeric tubular member cut and sealed to pouch the product. In some cases, polymeric fibers can be needle punched to strength or improve a seal, either before or after combining the polymeric fibers with smokeless tobacco (or similar material).

In some cases, methods and machines provided herein can rotate bodies or rods of tobacco material and/or tobacco substitute material in a polymer deposition zone to form a seamless tube of polymeric fibers around the bodies or rods. In some cases, a rod of tobacco material or similar material can be extruded. In some cases, an extruder producing a rod of tobacco material or similar material can be rotated to causes the extruded rod to rotate. In some cases, a support structure including at least two rollers can be used to support a rod as it is advanced through a polymer deposition zone. In some cases, a rod coated with a tube of polymeric fibers can be cut and sealed. In some cases, cutting and sealing the rod/tube combination can be completed in a single step. For example, a rod/tube combination can be cut and sealed as it exits a polymer deposition zone by a heated cutting device that pinch seals and cuts the tube and thus forms first and second cross-seals for each pouched smokeless tobacco product (or tobacco substitute product). As in some cases, supporting rollers are rotated to rotate bodies or rods of tobacco material and/or tobacco substitute material in a polymeric deposition zone. In some cases, an iris cutting device is used to cut and seal opposite ends of a tube to crease each pouched smokeless tobacco product (or tobacco substitute product). In some cases, a pair of cutting wheels, each having matching cutting surfaces at regular intervals, are used to cut and seal opposite ends of a tube to crease each pouched smokeless tobacco product (or tobacco substitute product). In some cases, hooks are used to cut and seal the rod/tube. In some cases, crimp jaws can be used to cut and seal the rod/tube. In some cases, an extruded rod can be passed or rotated between two or more opposite surfaces to reduce a diameter of the rod prior to passing the rod through a polymer deposition zone.

In some cases, individual bodies of tobacco material and/or tobacco substitute material can be produced by cutting an extruded rod of tobacco material or similar material prior to passing the individual bodies through the polymer deposition zone (e.g., by being supported on supporting rollers). In some cases, supporting rollers can be inclined and/or vibrated in order to promote movement of bodies or rods of tobacco material and/or tobacco substitute material through a polymer deposition zone in a desired direction.

In some cases, methods and machines provided herein can form a tube of polymeric fibers and deposit tobacco and/or tobacco substitute into said tube. In some cases, a tube of polymeric fibers can be made by rotating a dosing tube in a polymer deposition zone, which can be pulled off the dosing tube using take away rollers. A mixture of tobacco or similar material can be passed through the dousing tube and into the polymeric fiber tube. A cutting and sealing device can form cross seals above and below deposits of tobacco and/or a tobacco substitute. In some cases, an iris cutting device is used to cut and seal opposite ends of a polymeric fiber tube to seal each pouched product. In some cases, a pair of cutting wheels each having matching cutting surfaces at regular intervals are used to cut and seal opposite ends of a polymeric fiber tube to seal each pouched product. In some cases, crimp jaws can be used to cut and seal opposite ends of a polymeric fiber tube to seal each pouched product. In some cases, hooks are used to cut and seal each pouched product.

Methods and machines provided herein can, in some cases, form a coating of polymeric fibers on a substrate and wrap or fold the substrate around a deposit of tobacco and/or tobacco substitute to seal the tobacco and/or tobacco substitute in a non-woven polymeric-fiber sheet. In some cases, the substrate is folded around a deposit of tobacco and/or tobacco substitute. For example, the substrate can be paper. In some cases, a deposited coating on the substrate has a basis weight of 30 gsm or less. In some cases, a deposited coating on the substrate has a basis weight of 10 gsm or less. In some cases, the substrate can be an endless belt. For example, deposits of tobacco and/or tobacco substitute can be placed on a coating of polymeric fibers formed on an endless belt, and the endless belt can be bent up around the sides of the deposits to weld a longitudinal seal. Cross seals can additionally be made on both sides of each deposit, either before or after removing the substrate.

Methods and machines provided herein can, in some cases, form a polymeric fiber web into a pocket and seal the pocket. In some cases, methods and machines provided herein can forcing a polymeric fiber web and a tobacco and/or tobacco substitute material though an aperture to have the polymeric fiber web form into a pocket that encloses the tobacco and/or tobacco substitute material. For example, a machine provided herein can melt-blow, electro spin, or centrifugally force spinning a plurality of polymeric fibers onto an inside surface of a drum including a plurality of apertures there through. The drum can spin to form a coating of non-woven polymeric fibers on the inside surface and over the apertures. A depositing device can provide deposits of a mixture including tobacco, a tobacco substitute, or a combination thereof over the apertures and one the non-woven polymeric fibers. In some cases, deposits can migrate to the apertures if mistimed. The drum can spin at a rate sufficient to create a centrifugal force on the tobacco and/or tobacco substitute deposits sufficient to push the deposits and a portion of the non-woven polymeric fibers through the apertures to form a pocket in the polymeric fiber web. The non-woven polymeric fibers can then be cut and sealed at the aperture to seal tobacco and/or tobacco substitute material therein to form a plurality of polymeric-enclosed packages. In some cases, a cutting and sealing device at the aperture can be a heated scraper that removes additional polymeric fibers that remain on an inside surface of the drum. In some cases, apertures in the drum can have a smaller diameter on an inside surface of the drum and a larger diameter on an outer surface of said drum.

Methods and devices provided herein can additionally seal tobacco and/or tobacco substitute material by forming a peripheral seal around a deposit of tobacco and/or tobacco substitute material between two opposite webs of polymeric fiber. In some cases, methods provided herein can produce a sealed pouch having a basis weight of 30 gsm or less. In some cases, methods provided herein can produce a sealed pouch having a basis weight of 10 gsm or less. In some cases, polymeric fiber webs can be produced on a substrate including recesses adapted to receive a deposit of tobacco and/or tobacco substitute material. One or more deposits of a mixture including tobacco, a tobacco substitute, or a combination thereof can be placed into the recesses of said coated surface. Polymeric fibers can then be melt-blown, electro spun, or centrifugally force spun onto the deposits in the recesses of the coated surface to form a coating of non-woven polymeric fibers on the deposits. A cutting and sealing device can form a peripheral seal and cut around each deposit to form a plurality of polymeric-enclosed packages. In some cases, melt-blown, electro spun, or centrifugally force spun fibers can be performed and vacuum formed against a surface including a plurality of recesses.

In some cases, methods and machines provided herein can spray a surfactant at the polymeric material as the polymer strands exit the melt-blowing device, electro spinning device, centrifugal force spinning device, or downstream of a web forming process. The surfactant can provide a hydrophilic surface. The surfactant can also quench the polymeric fibers.

Methods and machines provided herein can be used to pouch other orally consumable plant materials in addition to smokeless tobacco. For example, some non-tobacco or "herbal" compositions have also been developed as an alternative to smokeless tobacco compositions. Non-tobacco products may include a number of different primary ingredients, including but not limited to, tea leaves, red clover, coconut flakes, mint leaves, citrus fiber, bamboo fiber, ginseng, apple, corn silk, grape leaf, basil leaf, and other cellulosic materials. In some cases, such a non-tobacco smokeless product can further include tobacco extracts, which can result in a non-tobacco smokeless product providing a desirable mouth feel and flavor profile. In some cases, the tobacco extracts can be extracted from a cured and/or fermented tobacco by mixing the cured and/or fermented tobacco with water (or other solvents) and removing the non-soluble tobacco material. In some cases, the tobacco extracts can include nicotine. In some cases, a pouched non-tobacco product has an overall oven volatiles content of at least 10 weight percent. In some cases, a pouched non-tobacco product has an overall oven volatiles content of at least 40 weight percent. Methods and machines provided herein can also be used to pouch other products. For example, methods and machines provided herein can be used to produce tea bags.

Unless otherwise defined, all technical and scientific terms used herein have the same meaning as commonly understood by one of ordinary skill in the art to which the methods and compositions of matter belong. Although methods and materials similar or equivalent to those described herein can be used in the practice or testing of the methods and compositions of matter, suitable methods and materials are described below. In addition, the materials, methods, and examples are illustrative only and not intended to be limiting. All publications, patent applications, patents, and other references mentioned herein are incorporated by reference in their entirety.

DESCRIPTION OF DRAWINGS

Like reference symbols in the various drawings indicate like elements.

DETAILED DESCRIPTION

Methods and machines provided herein can pouch smokeless tobacco, tobacco substitutes, and/or similar materials (e.g., tea). Methods and machines provided herein are adapted to provide pouched smokeless tobacco products that can retain the smokeless tobacco material contained within the pouch, but provide an adult tobacco consumer with desirable flavor and tactile experience. In some cases, methods and machines provided herein can pouch smokeless tobacco (and similar materials) with polymeric webs unsuitable for use in a conventional pouching machine.

Methods and machines provided herein can pouch smokeless tobacco (and similar materials) in any suitable material. In some cases, methods and machines provided herein pouch smokeless tobacco (or similar materials) in non-woven polymeric fibers. In some cases, methods and machines provided herein can melt-blow, electro spin, or force spin a plurality of polymeric fibers to form a non-woven web of polymeric fibers.

Figure 20:
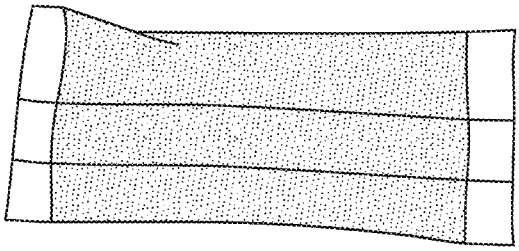
FIG. 20 (Prior Art)
FIG. 20 is an exemplary picture of a prior art pouch.
Figure 21:
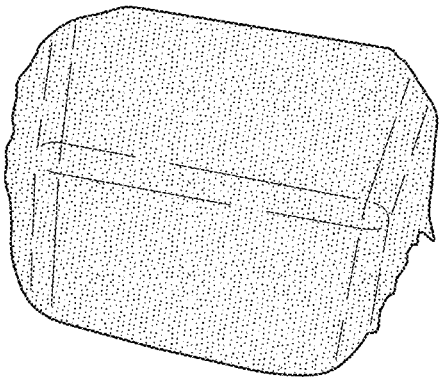
FIG. 21 is a picture of a pouched product provided herein.

Methods and machines provided herein can, in some cases, pouch smokeless tobacco (and similar materials) in non-woven webs of elastomeric polymer fibers. In some cases, the use of elastomeric polymers, such as polyurethane, in pouched smokeless tobacco products made using the methods and machines provided herein can provide an adult tobacco consumer with a desirable flavor and tactile experience due to reduced seals, improved moldability, improved chewability, controllable flavor release, and/or an improved visual appearance as compared to a conventional pouched smokeless tobacco product. For example, polyurethane and other suitable elastomeric polymers can be thermally bonded without a need to use a chemical binder or treatment, thus individual fibers be sealed and cut in a single step with a minimized seal line. FIG. 21 depicts an exemplary pouched product that can be produced using methods and machines provided herein. As shown, seal 2170 has a smaller width as compared to the seals 2270 found in traditional pouched product 2208 depicted in FIG. 20. Accordingly, the use of elastomeric polymer fibers (e.g., polyurethane fibers) as a pouching material can provide an improved mouth feel. Elastomeric polymers can also allow an adult tobacco consumer to mold and/or chew a pouched smokeless tobacco product in their mouth, which can allow for an adult tobacco consumer to both pack and unpack the packing density of the pouch, which can help control a flavor release rate. By unpacking a packing density of a pouch, an adult tobacco consumer can increase a flavor release rate. Additionally, in some cases, elastomeric polymer fibers can be hydrophilic and have good wicking properties, thus an elastomeric polymeric fiber web provided herein can have a moist appearance. In some cases, methods and machines provided herein can produce and/or use webs of polyurethane fibers. In addition to polyurethane, other suitable elastomeric polymers suitable for methods and machines provided herein include styrenes (including styrene block copolymers), EVA (ethyl vinyl acetate), and/or polyether block amides. In some cases, non-elastomeric polymers can be used in methods and machines provided herein. Suitable non-elastomeric polymers include rayon, polypropylene, polyethylene, polyethylene terephthalate, and cellulose. In some cases, blends and/or composites of multiple polymers can provide suitable elastomeric or non-elastomeric polymeric fiber webs. In some cases, a blend of polyurethane, polypropylene, and styrene can be compounded and used as an elastomeric polymeric fiber web.

Methods and machines provided herein can, in some cases, pouch smokeless tobacco or similar materials with a low basis weight web of polymeric fiber. In some cases, methods and machines provided herein can pouch smokeless tobacco or similar materials with a polymeric fiber web having a tensile strength of less than 4 mJ. Low basis weight webs can, in some cases, have a tensile strength insufficient for many conventional pouching machines. Methods and machines provided herein can, in some cases, permit smokeless tobacco (or a similar material) to be pouched in a low basis weight and/or low tensile strength web. In some cases, methods and machines provided herein can pouch smokeless tobacco (or a similar material) in a web having a basis weight of less than 30 gsm, less than 20 gsm, less than 10 gsm, or less than 5 gsm. In some cases, methods and machines provided herein can pouch smokeless tobacco (or a similar material) in a web having a tensile strength of less than 4 mJ, less than 3 mJ, less than 2 mJ, or less than 1 mJ.

Forming Polymeric Fiber Webs

Figure 1A:
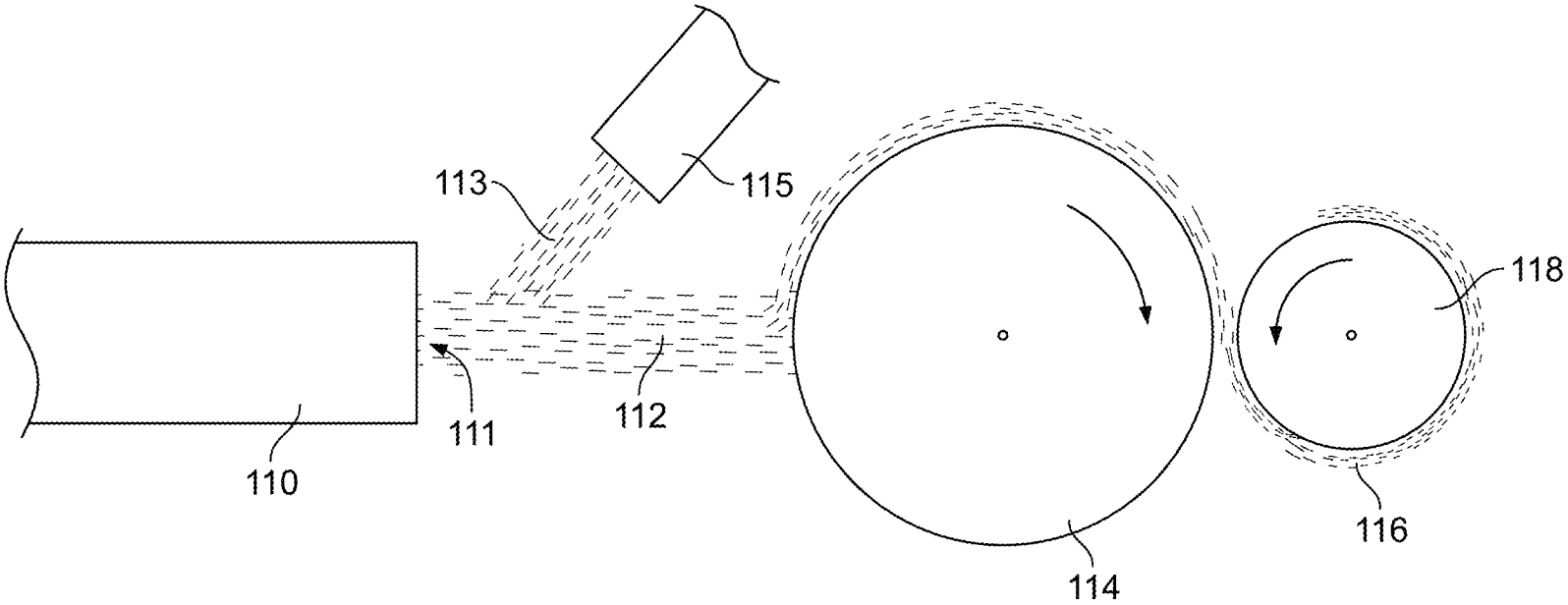
FIG. 1A depicts an exemplary arrangement depicting how a web of polymeric fibers can be produced.

Polymeric material can be melt-blown, electro spun, or centrifugally force spun to produce polymeric fibers, which can be delivered towards one or more surfaces to form non-woven polymeric fiber webs. In some cases, such as shown in FIG. 1A, a web of polymeric fibers 116 can be produced by using a polymer spray head 110 to deliver a plurality of polymeric fibers 112 towards a collection surface (e.g., collection roller 114). As the fibers impact collection roller 114, the fibers become tangled and thus form a non-woven polymeric fiber web 116. In some cases, collection roller 114 can pull a vacuum. As a web 116 is produced, it can be wound onto a storage roller 118 for transport and/or storage before use in a method or machine provided herein.

The fabric can be made by melt-blowing polymeric fibers, electro spinning fibers, centrifugal force spinning polymeric fibers, or a combination thereof. Melt-blowing and centrifugal force spinning methods are discussed below.

Melt-Blowing Processes

The device shown in FIG. 1A can include a melt-blowing polymer spray head 110. In some cases, the melt-blown polymeric fibers 112 can have diameters of less than 100 microns (or less than 50 microns, or less than 30 microns, or less than 10 microns, or less than 5 microns, or less than 1 micron, or less than 0.5 microns. In some cases, the melt-blown polymeric fibers 112 have a diameter of between 0.5 and 5 microns. Melt-blowing is an extrusion process where molten polymeric resins are extruded through an extrusion die and gas is introduced to draw the filaments to produce polymeric fibers. The gas can be heated air blown at high velocity through orifices that surround each spinneret or in air slots around each individual spinneret. In some cases, layers of hot air are blown through slots between rows of spinnerets—the strands of polymeric material are attenuated by being trapped between two layers of air. Other methods of delivering the attenuating gas (e.g., heated air) are possible. The polymeric fibers can be deposited onto a support surface (e.g., moving conveyor or carrier).

Figure 17:
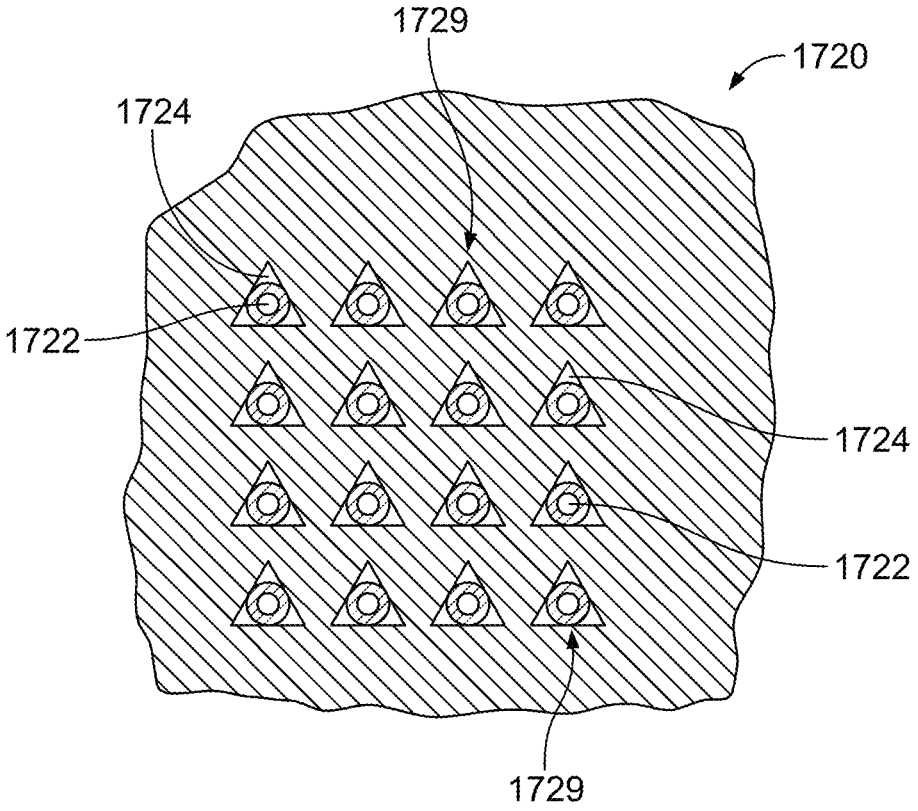
FIG. 17 depicts an exemplary arrangement of polymer orifices and air orifices for a melt-blowing apparatus.

FIG. 17 depicts an exemplary melt-blowing device 1720. Other melt-blowing devices are described in U.S. Pat. Nos. 4,380,570; 5,476,616; 5,645,790; and 6,013,223 and in U.S. Patent Applications US 2004/0209540; US 2005/0056956; US 2009/0256277; US 2009/0258099; and US 2009/0258562, which are hereby incorporated by reference. The melt-blowing device 1720 can include a polymer extruder that pushes molten polymer at low melt viscosities through a plurality of polymer orifices 1722. The melt-blowing device 1720 includes one or more heating devices that heat the polymer as it travels through the melt-blowing device 1720 to ensure that the polymer remains above its melting point and at a desired melt-blowing temperature. As the molten polymer material exits the polymer orifice 1722, the polymer material is accelerated to near sonic velocity by gas being blown in parallel flow through one or more air orifices 1724. The air orifices 1724 can be adjacent to the polymer orifices 1722. The air orifices 1724 may surround each polymer orifice 1722. Each combination of a polymer orifice 1722 with surrounding air orifices 1724 is called a spinneret 1729. For example, the melt-blowing device 1720 can have between 10 and 500 spinnerets 1729 per square inch. The polymer orifices 1722 and the gas velocity through gas orifices 1724 can be combined to form fibers of 100 microns or less. In some cases, the spinnerets each have a polymer orifice diameter of 30 microns or less. In some cases, the melt-blown polymeric fibers 112 can have diameters of between 0.5 microns and 5 microns. The factors that affect fiber diameter include throughput, melt temperature, air temperature, air pressure, and distance from the drum. In some cases, the spinnerets 1729 each have a polymer orifice diameter of less than 1800 microns. In some cases, the spinnerets 1729 each have a polymer orifice diameter of at least 75 microns. The average polymer orifice diameter can range from 75 microns to 1800 microns. In particular embodiments, the average polymer orifice diameter can be between 150 microns and 400 microns. In certain cases, polymer orifice diameters of about 180 microns, about 230 microns, about 280 microns, or about 380 microns are used. In some cases, some spinnerets can also include orifices that provide air flows without polymer to provide additional attenuation and direction of polymer fibers produced from other spinnerets.

Referring back to FIG. 1A, a rotating vacuum drum 114 can be adapted to produce a vacuum in the area behind the spinnerets. The vacuum can pull the melt-blown polymeric fibers towards the rotating vacuum drum 114 and may assist in fiber bonding. In some cases, a moving conveyor (optionally passing over a vacuum chamber) can be used instead of the rotating vacuum drum 114. In some cases, no vacuum is used during the melt-blowing process, which may result in a more random distribution of fibers and less fiber-to-fiber bonding during an initial melt-blowing process. The melt-blown system can, in some cases, include one or more spray nozzles 115 for directing a quenching fluid, surfactant, or other treatment solution 113 towards the stream of fibers as they exit the melt-blowing polymer spray head 110. The possible treatment fluids are discussed below in greater detail.

Electro Spinning Systems

Electro spinning is a process that spins fibers of diameters ranging from 10 nm to several hundred nanometers; typically polymers are dissolved in water or organic solvents. The process makes use of electrostatic and mechanical force to spin fibers from the tip of a fine orifice or spinneret. The spinneret is maintained at positive or negative charge by a DC power supply. When the electrostatic repelling force overcomes the surface tension force of the polymer solution, the liquid spills out of the spinneret and forms an extremely fine continuous filament. These filaments are collected onto a rotating or stationary collector with an electrode beneath of the opposite charge to that of the spinneret where they accumulate and bond together to form nanofiber web.

Centrifugal Force Spinning Processes

Figure 18A:
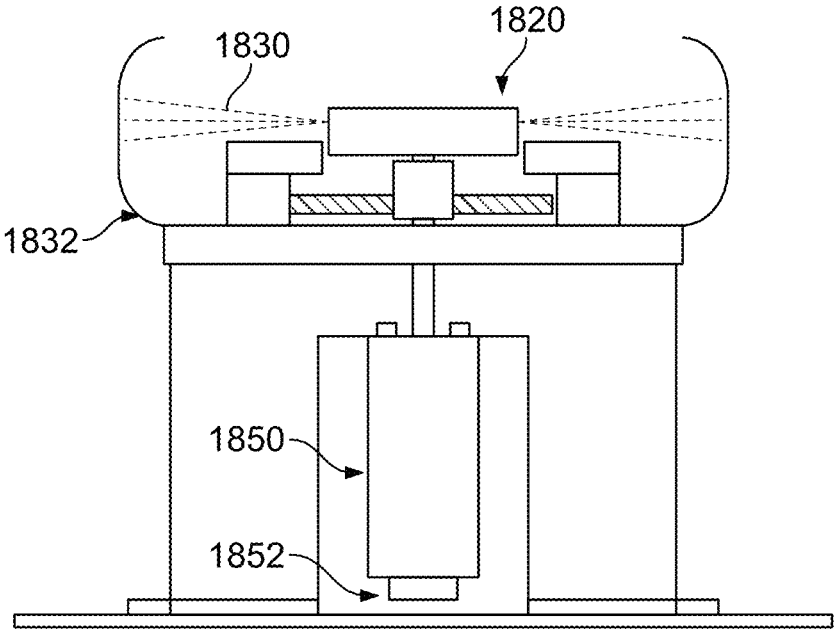
FIGS. 18A-18E depicts an exemplary system for centrifugal force spinning fibers to create a fabric.
Figure 18B:
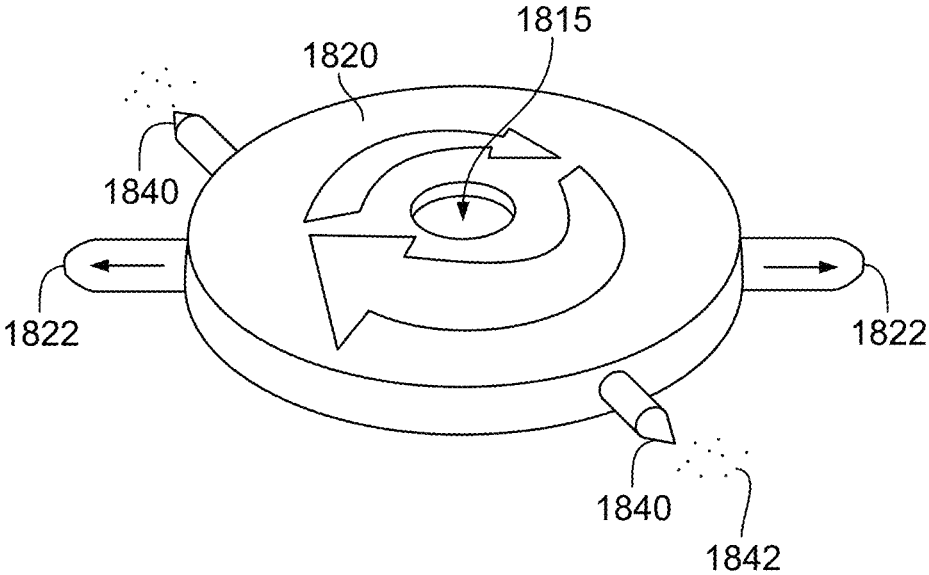
Figure 18C:
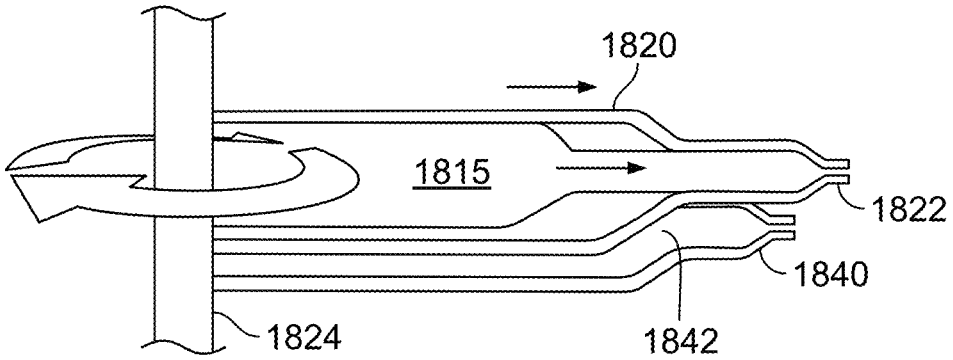
Figure 18D:
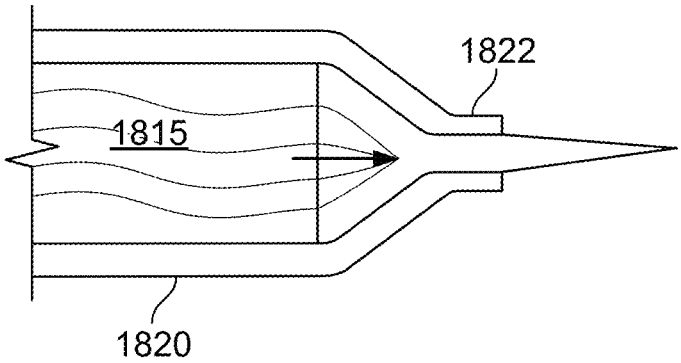
Figure 18E:
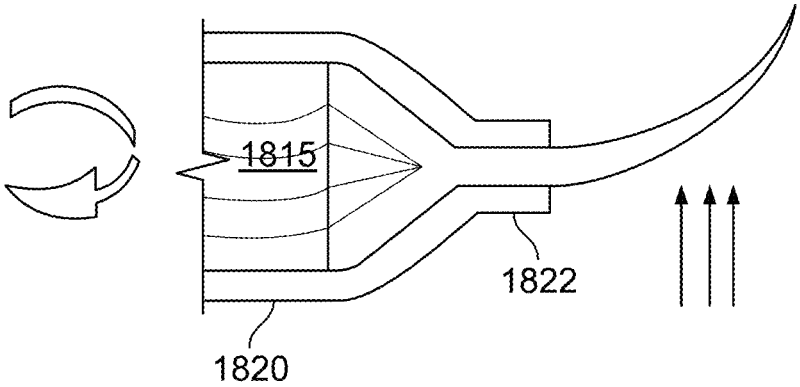

Centrifugal force spinning is a process where centrifugal force is used to create and orient polymeric fibers. FIGS. 18A-18E depict an exemplary centrifugal force spinning apparatus. As shown, a spinneret 1820 holds polymeric material 1815 and is rotated at high speeds with a motor 1850 to produce polymeric fibers 1830 that are deposited onto a fiber collector 1832 to create a centrifugal force spun web 1860. FIG. 18B depicts a close-up of the spinneret 1820 showing two orifices 1822. Any number of orifices 1822 can be used. The centrifugal force spinning apparatus can also include one or more spray nozzles 1840 for directing a quenching fluid, surfactant, or other treatment solution 1842 towards the stream of fibers as they exit the spinneret orifices 1822. FIG. 18C depicts how the spinneret 1820 can be equipped to also provide a treatment fluid 1840 and a spray nozzle 1842. The possible treatment fluids are discussed below in greater detail.

The fiber collector 1832 can be a continuous drum or a series of spaced collection fingers. As the spinneret 1820 rotates, the polymeric material (in a liquid state) is pushed to the orifices 1822 lining the outer wall of the spinneret 1820. As the polymeric material enters the orifice chamber, molecules disentangle and then align directionally. Centrifugal and hydrostatic forces combine to initiate a liquid material jet. The external aerodynamic environment combined with the inertial force of continued rotation further applies shear forces and promote cooling and/or solvent evaporation to further stretch the fiber. The inertia force can stretch molecular chains into the nanoscale and the air turbulence can apply a shear force.

Figure 19:
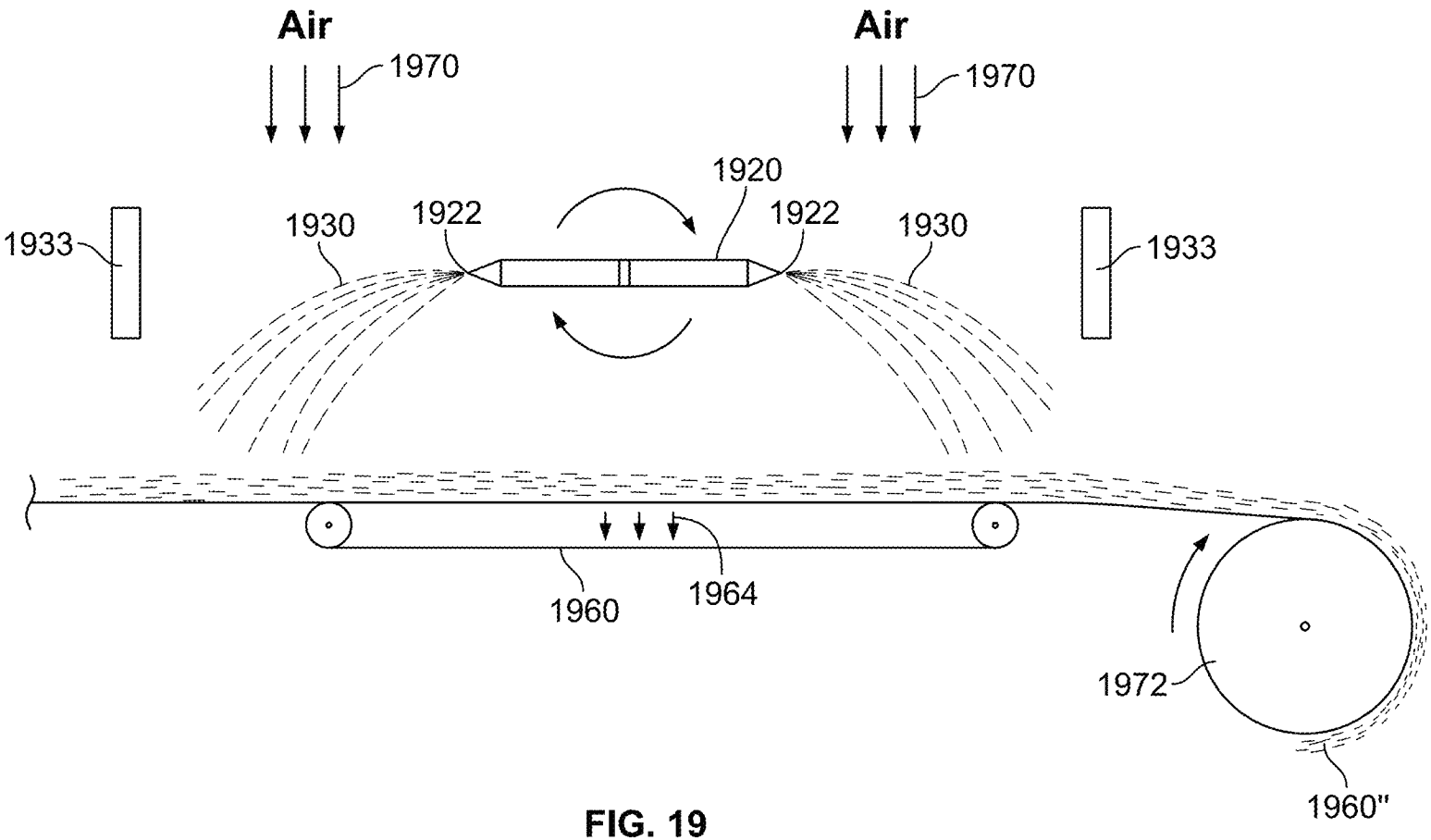
FIG. 19 depicts an alternative arrangement for forming a fabric by centrifugally force spinning fibers.

FIG. 19 depicts an alternative arrangement for creating a centrifugal force spun web 1960. As shown, a spinneret 1920 is positioned above a conveyor 1960. A carrier 1936 can be used to collect a centrifugal force spun web 1960. As shown, centrifugal force spun fibers exit spinneret orifices 1922 approximately perpendicular to the carrier 1936. The fibers 1930 encounter a stream of air 1970 (and optionally treatment fluids as discussed below) which direct the centrifugal force spun fibers towards the carrier 1936. A conveyor 1962 supporting the carrier 1936 can draw a vacuum 1964 to facilitate the laying of a centrifugally force spun web 1960. In some cases, the carrier 1936 is a porous carrier that facilitates the drawing of a vacuum through the carrier 1936. Collection fingers 1933 can be positioned around the spinneret 1920 to collect any stray fibers. The centrifugal force spun web can be collected on a pickup roll 1972. In some cases, centrifugal force spun fibers can improve a web strength and random orientation of polymeric fibers deposited onto a product portion due to a long fiber length.

Methods and Machines for Pouching

Method and machine provided herein can form and/or use one or more webs of polymeric fibers in a pouching operation. In some cases, a web of polymeric fibers can be performed using a method describe above in reference to FIG. 1A, 17, 18, or 19, and used in a method discussed below in reference to FIGS. 1B, 1C, and 12. In some cases, such as discussed below in reference to FIGS. 3, 5, 9-10A, 13, and 15, polymeric fiber can be melt blown, electro spun, and/or force spun onto a substrate to form a web prior to combining that web with smokeless tobacco (or a similar material) to form a pouched product. In some cases, such as discussed below in reference to FIGS. 2A-2B, 3, 7A, 7B, and 8, polymeric fiber can be melt blown, electro spun, and/or force spun direction onto the smokeless tobacco (or similar material). In some cases, such as discussed below in reference to FIG. 3, polymeric fiber can form a web against a substrate and form a second web against the smokeless tobacco (or similar material).

Sandwich Pouch Methods and Machines

Figure 1B:
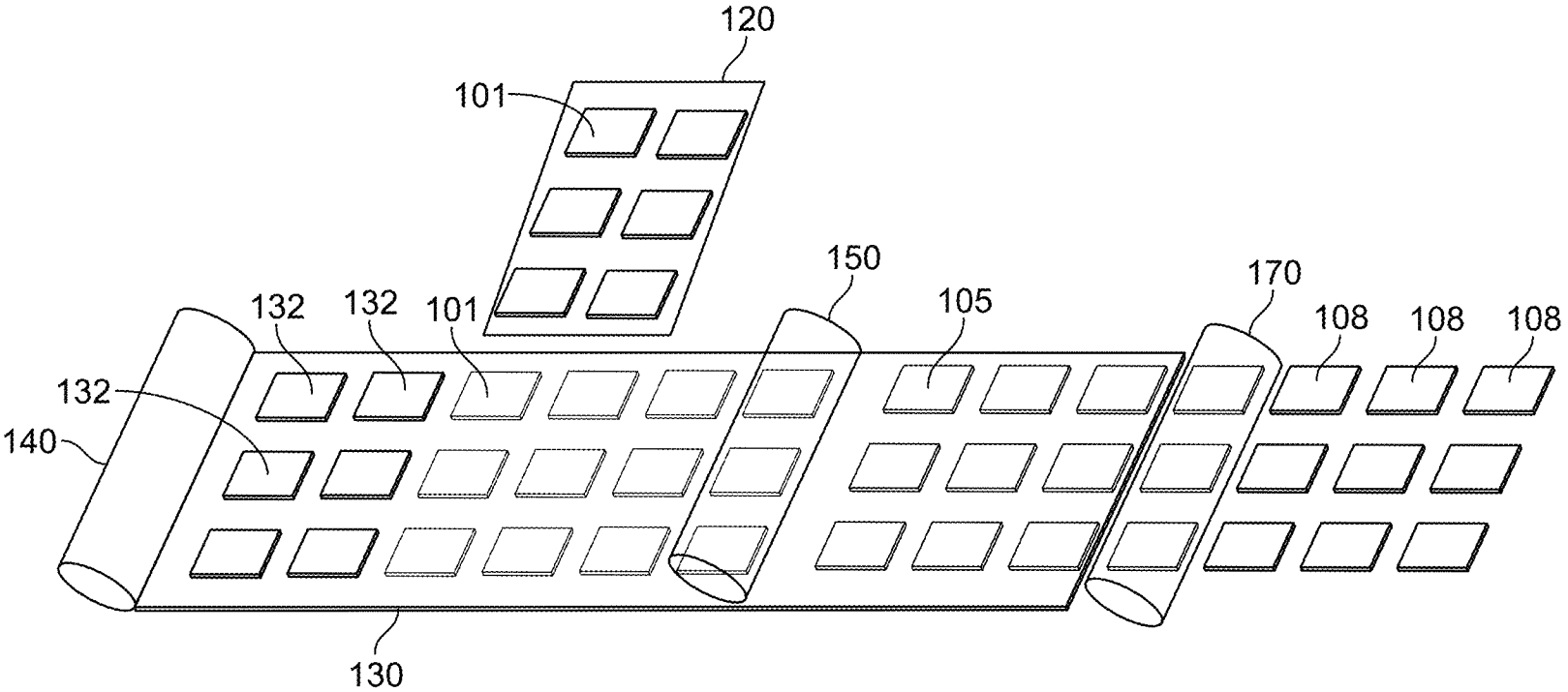
FIG. 1B schematically illustrates a method of sealing webs of polymeric fibers around molded bodies.
Figure 1C:
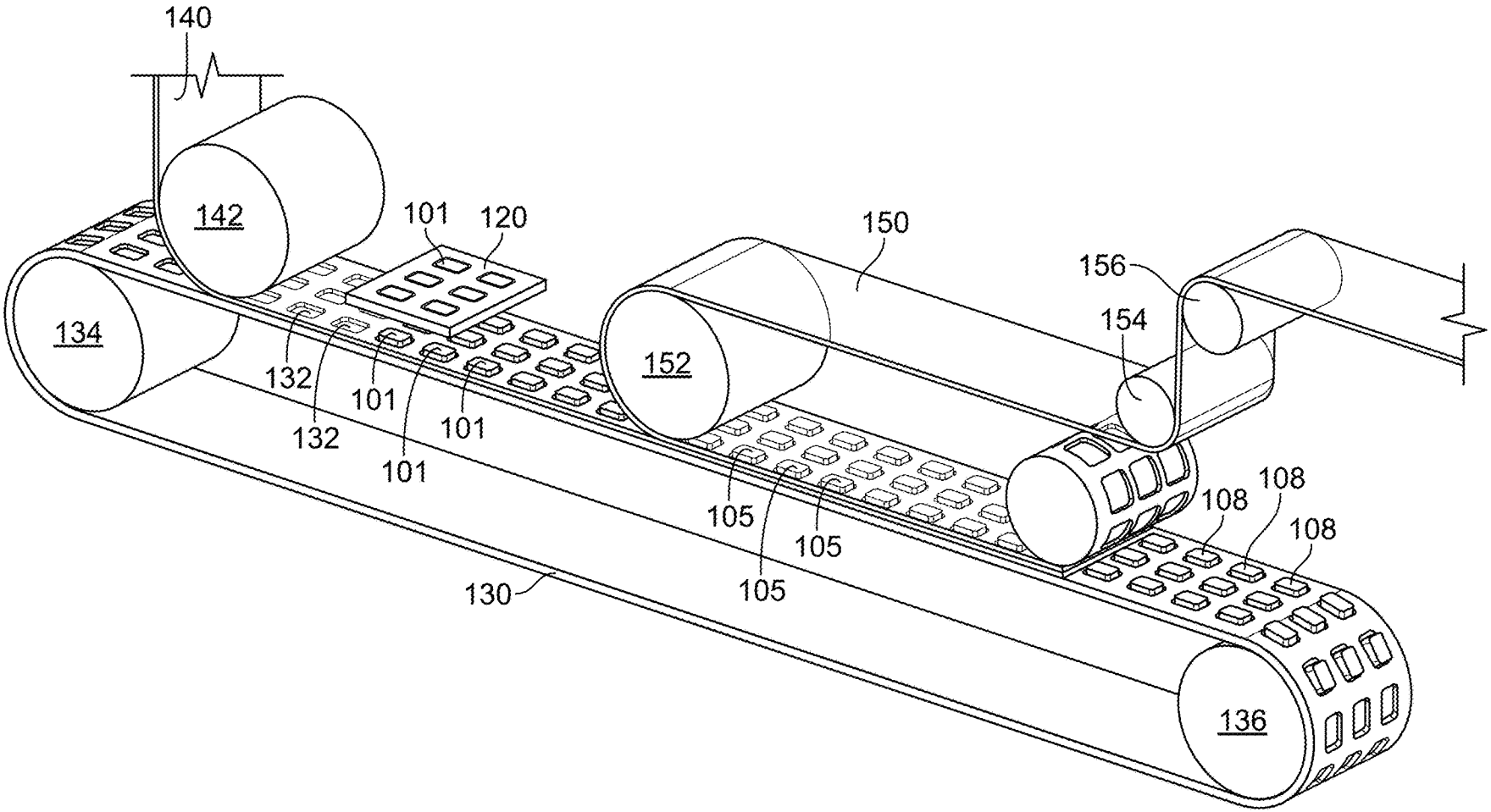
FIG. 1C depicts an exemplary apparatus for sealing webs of polymeric fibers around molded bodies.

FIG. 1B schematically illustrates a method of sealing webs of polymeric fibers around the periphery of molded bodies including smokeless tobacco or a similar material. FIG. 1C depicts an exemplary apparatus for sealing webs of polymeric fibers around molded bodies. As shown, preformed webs 140 and 150 can be supplied to apparatus of FIGS. 1B and 1C. In some cases, preformed webs 140 and 150 can be melt blown polyurethane having a basis weight of less than 30 gsm, less than 20 gsm, less than 10 gsm, or less than 5 gsm. As shown, first web 140, molded portions 101, and second web 150 are sequentially supplied to a top surface of conveyor 130. Conveyor 130 can be moved by rotating conveyor rollers 134 and 136. Conveyor 130 can include recesses 132 in the top surface. Recesses 132 can be sized and shaped to correspond to molded portions 101. First web 140 can be applied to the top surface of conveyor 130 such that first web 140 conforms to recesses 132. In some cases, first web 140 is supplied to the top surface of conveyor 130 by a first web supply roller 142. In some cases, first web supply roller 142 can have surface features that correspond to recesses 132 to press portions of first web 140 into recesses 132. In some cases, a vacuum can be applied to draw first web 140 into recesses 132.

A molding device 120 can be used to shape a material (e.g., smokeless tobacco material) in a molded portion 101 having a shape and size corresponding to recesses 132. In some cases, molding device 120 can include a die having apertures corresponding to a desired shape and size of molded portion 101. For example, a mold can include a die plate having apertures there through and a material including smokeless tobacco and binder can be compressed into the apertures by at least one piston received at least one side of the apertures. An exemplary molding device is sold under the tradenames FORMAX F-6 and F-19. Molded portions 101 can be knocked out onto first web 140 and be positioned in recesses 132. In some cases, a die plate can have a pattern corresponding to a pattern of recesses 132 on conveyor 130.

Second web 150 can be applied over first web 140 and molded portions 101 in recess 132 using second web supply roller 152 and secondary rollers 154 and 156. In some cases, second web supply roller 152 can have cavities that correspond to cavities 132 in order to shape second web 150 around molded portions 101. After second web 150 is applied, covered molded portions 105 are surrounded by opposite webs of polymeric fiber.

Seal cutter roller 170 can heat cut and heat seal around a periphery of each covered molded portion 105 to produce pouched products 108. As shown, seal cutter roller 170 can include recesses corresponding to recesses 132 in order cut around each covered molded portion 105. In some cases, seal cutter roller 170 can cut and seal using ultrasonic energy.

Figure 2A:
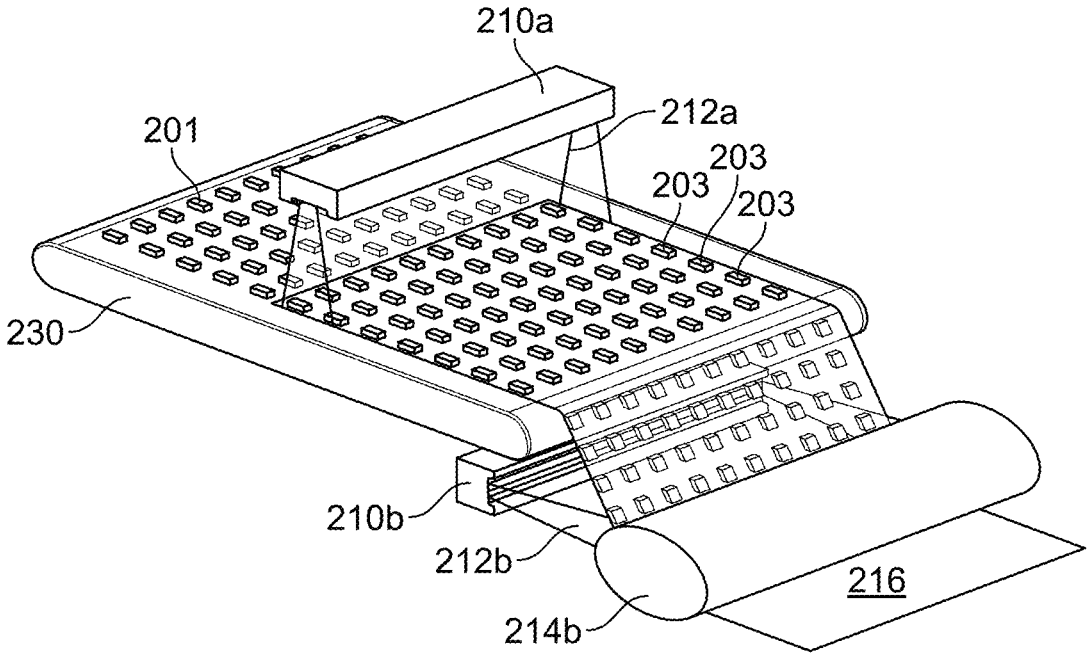
FIGS. 2A and 2B depict an exemplary apparatus for directly applying polymeric fibers from polymer spray heads to opposite sides of molded bodies.
Figure 2B:
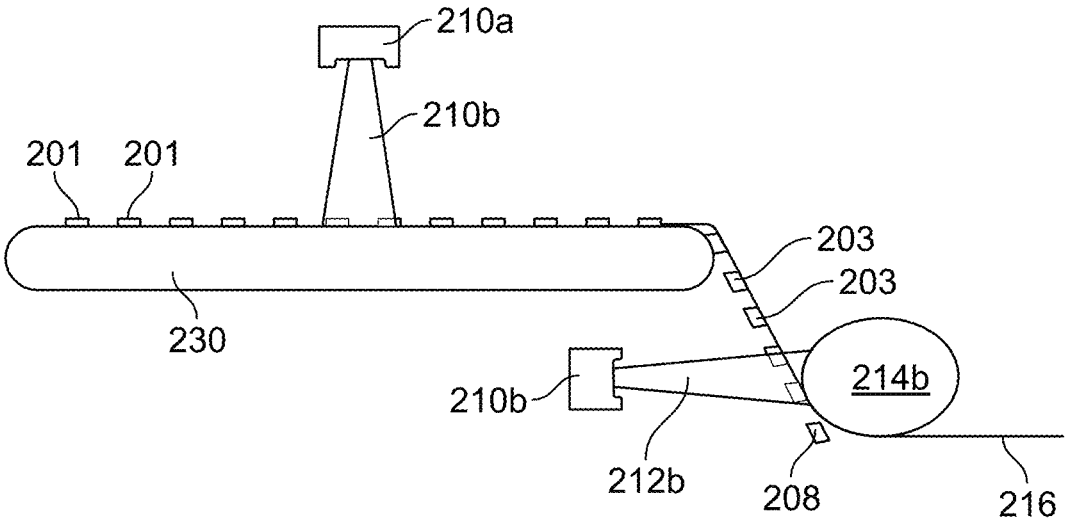

FIGS. 2A and 2B depict an exemplary apparatus for directly applying polymeric fibers from polymer spray heads to opposite sides of molded bodies. As shown, molded portions 201 can be deposited on conveyor 230 and passed under a first polymer spray head 210*a*. Polymer spray head 210*a* can provide melt blown, electro spun, and/or force spun polymeric fibers 212*a* over an upper surface of molded portions 201 to produce partially covered molded portions 203 under a web 216 of polymeric fibers, which can be drawn off conveyor 230 by roller 214*b*. As web 216 and partially covered molded portions 203 leave conveyor 230 and move around roller 214*b*, a second polymer spray head 210*b* can provide melt blown, electro spun, and/or force spun polymeric fibers 212*b* to an under surface of molded portions 203 to create fully covered molded portion 206. In some cases, a basis weight of web 216 can be sufficient low to allow molded portions 206, including an upper coating of polymeric fibers, to rip away from a remainder of the web once unsupported by conveyor 130. In some cases, molded portions 206 can be cut away from a remainder of the web 216. In some cases, the apparatus of FIGS. 2A and 2B includes a cutting device on roller 214*b* to cut and/or seal fully covered pouched products 206 from a remainder of web 216. In some cases, fully covered pouched products 206 can be heated after collection to heat bond adjacent polymeric fibers to create a more secure pouch.

Figure 3:
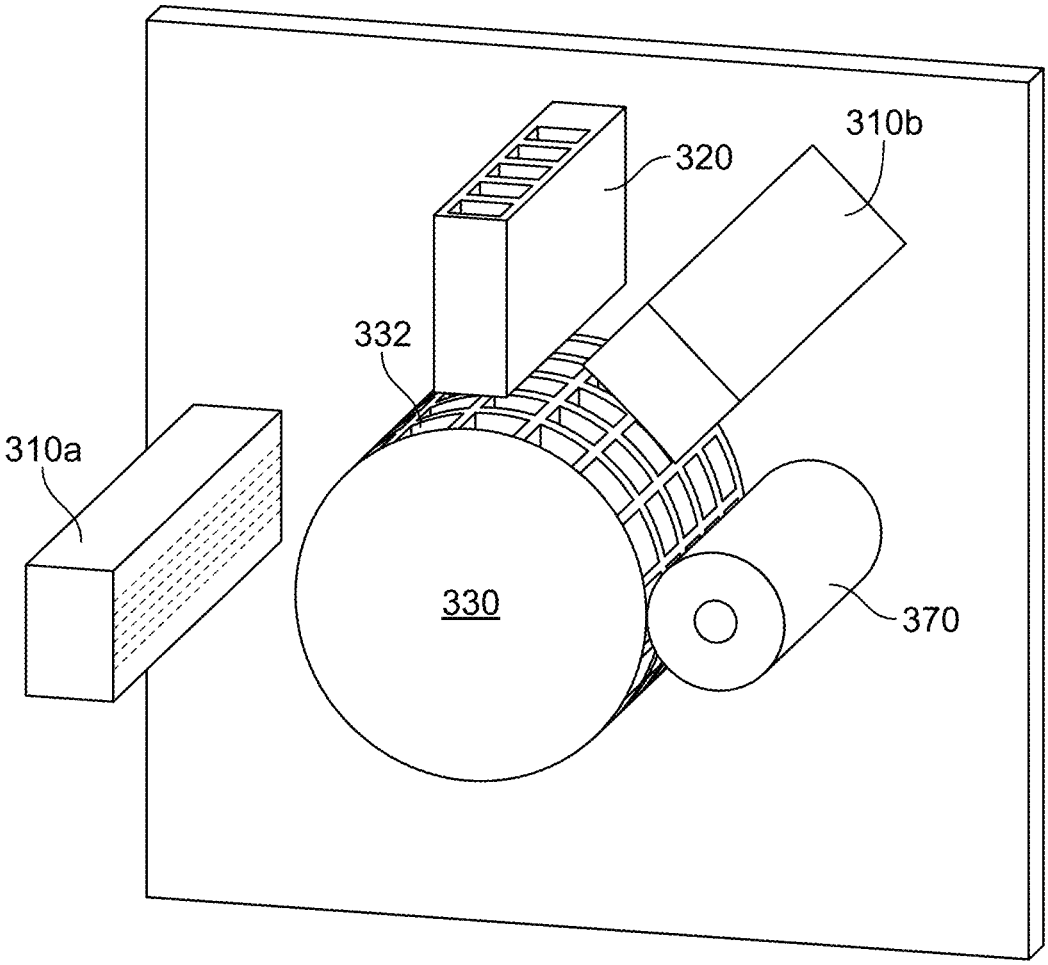
FIG. 3 depicts an exemplary apparatus for directly applying polymeric fibers to a top side of molded bodies.
Figure 4A:
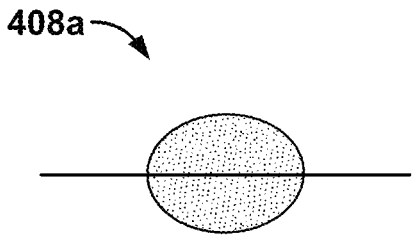
FIGS. 4A and 4B depict exemplary product forms that may be produced using the apparatus of FIG. 3.
Figure 4B:
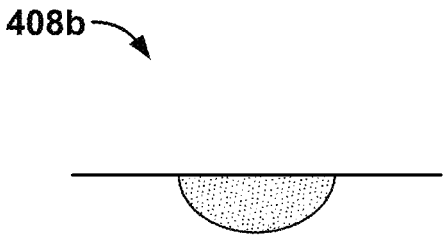

FIG. 3 depicts a second exemplary apparatus for directly applying polymeric fibers from a polymer spray head to a top side of molded bodies. As shown, first polymer spray head 310*a* can supply a stream of polymeric fibers to form a first web on drum 330 including recesses 332. Recesses 332 are shaped and sized to receive molded portions (e.g., molded tobacco portions) from molding device or depositing device 320. Second polymer spray head 310*b* then sprays an upper surface of each molded portion in each recess 332 to form a fully covered molded portion (not shown). A weld and cut roller 370 rolls against drum 330 to cut and seal individual pouched product portions. FIGS. 4A and 4B depict exemplary product forms that may be produced using the apparatus of FIG. 3. In some cases, web and cut roller 370 can include recesses corresponding to recesses 332 in order to get a product having an arrangement of pouched product 408*a*, as shown in FIG. 4A. In some cases, web and cut roller 370 can include smooth cylindrical surface in order to get a product having an arrangement of pouched product 408*b*, as shown in FIG. 4B.

Sandwich pouching methods and machines provided herein can operate with a continuous motion and thus have a high speed of operation and can minimize an amount of polymer waste. Although certain arrangements are shown, the particular architecture can be reconfigured, but function in the same fundamental ways depicted here. In some cases not shown, correspond drums each having matching recesses can each be coated with polymeric fibers, have tobacco or a similar material deposited into recesses on at least one drum, and have the drums press together to form a fully covered product, which can subsequently be sealed and cut.

Pocket Pouches

Figure 5:
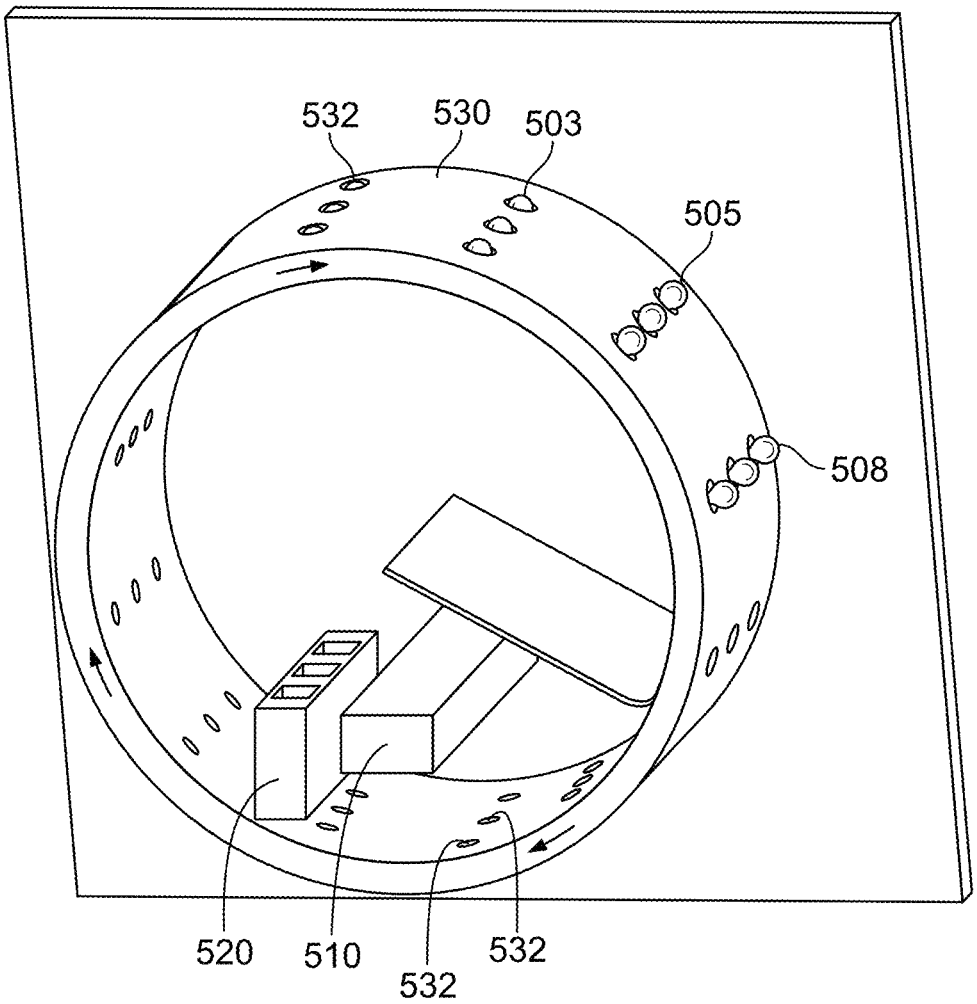
FIG. 5 depicts an exemplary apparatus for producing and wrapping a web of polymeric fiber around a deposit of smokeless tobacco or similar material using centrifugal force.
Figure 6:
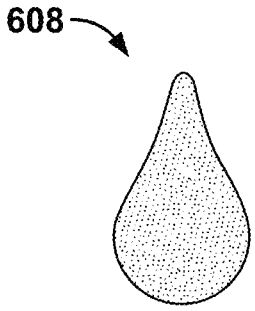
FIG. 6 depicts an exemplary product form that may be produced using the apparatus of FIG. 5.

FIG. 5 depicts an exemplary apparatus for producing a pocket in a web of polymeric fiber filled with smokeless tobacco or a similar material therein and heat sealing the pocket. As shown, FIG. 5 includes a hollow drum 530 having an inside surface, an outside surface, and a plurality of apertures 532 there through. Polymer spray head 510 can deposit polymeric fibers on the inside surface as hollow drum 530 rotates clockwise. A product mold 520 or product deposition device can be positioned adjacent to polymer spray head 510 to deposit a plurality of bodies including smokeless tobacco or a similar material onto a web deposited by polymer spray head 510 over apertures 532. In some cases, bodies of smokeless tobacco or similar material can migrate towards apertures 532 even if not initially positioned there. The rotation of drum 530 can provide a sufficient centrifugal force to cause deposits of smokeless tobacco and/or other material to push a portion of web over each aperture to be pushed out of said aperture and form a pocket filled with smokeless tobacco and/or other material. An opening to the pocket can then be heat sealed and separated from a remainder of the web. In some cases, the apparatus of FIG. 5 can include a heated scraping tool inside drum 530 to cut away and seal web material positioned in apertures. In some cases, apertures 532 have a smaller diameter on the inside surface than an aperture on an exterior surface. FIG. 6 depicts an exemplary tear drop shaped product 608 that may be produced using the apparatus of FIG. 5.

Tubular Pouches

Figure 7B:
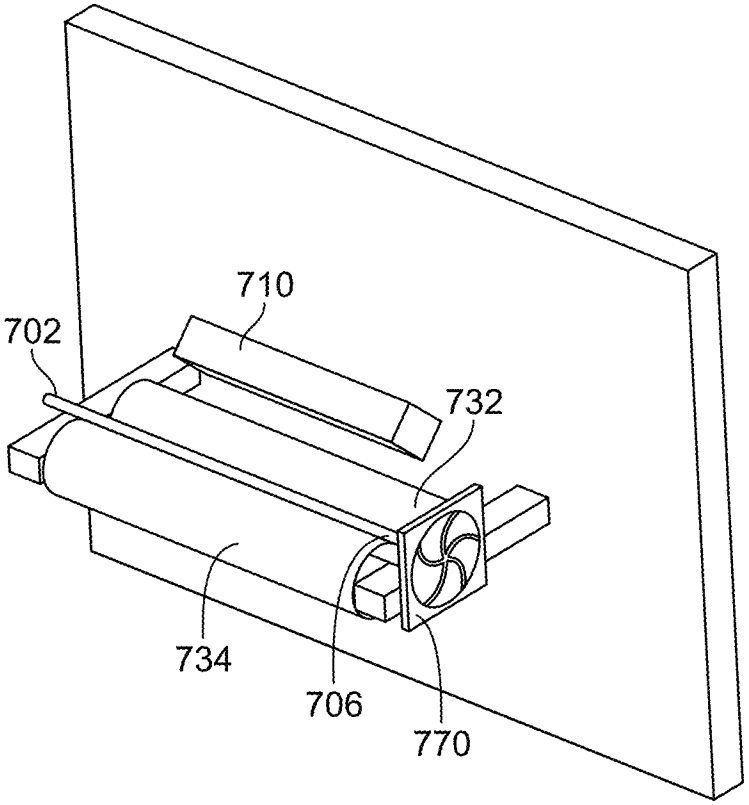
FIG. 7B depicts a second exemplary apparatus for forming a tube of polymeric fibers directly on a rod of smokeless tobacco or similar material and dividing the tube/rod combination into individual pouched products.
Figure 7A:
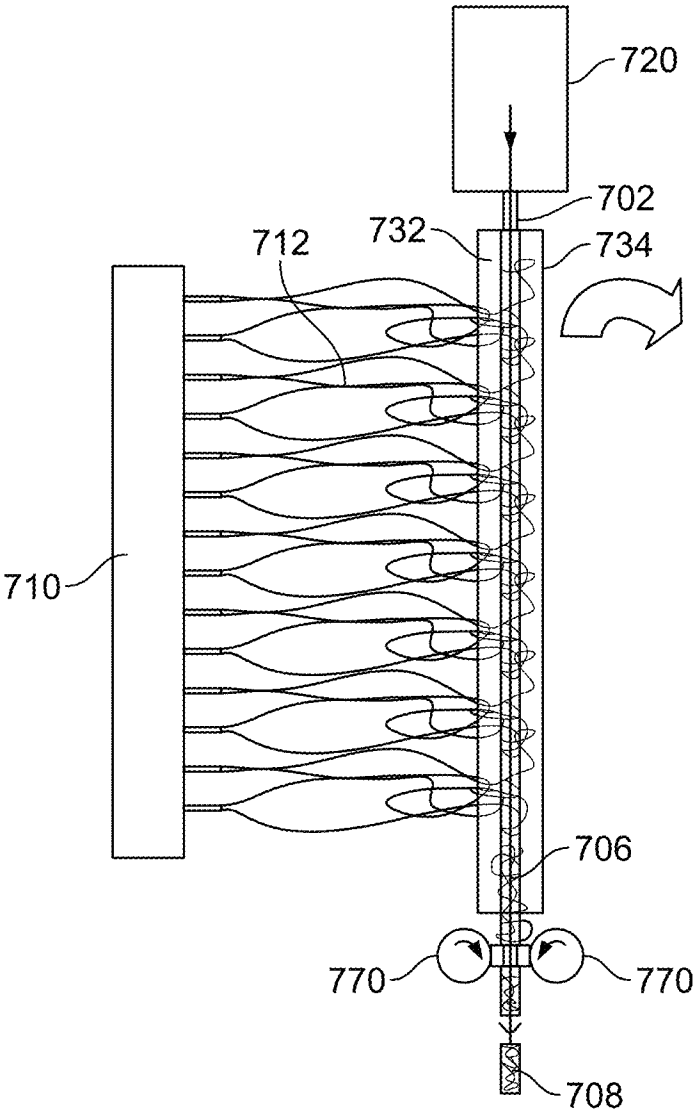
FIG. 7A depicts an exemplary apparatus for forming a tube of polymeric fibers directly on a rod of smokeless tobacco or similar material and dividing the tube/rod combination into individual pouched products.

FIGS. 7A, 7B, 8, 9, 10A, and 12 depict methods and machines that form or use tubular webs to pouch smokeless tobacco or similar material. In some cases, such as FIGS. 7A and 7B depict apparatuses that position a rod 702 of smokeless tobacco or similar material in a polymer deposition zone 712 created by a polymer spray head 710. In some cases, polymer spray head 710 is a melt blowing apparatus. As shown in FIG. 7A, a rod 702 can be produced by an extruder 720. In some cases, a mixture including smokeless tobacco, a tobacco substitute, or a similar material can be rolled two or more surfaces to create a rod 702. Rod 702 can supported on two or more rollers 732 and 734 as it passes through polymer deposition zone 712. Rollers 732 and 734 can rotate about their axis to cause rod 702 to rotate/twist as it passes through polymer deposition zone 712, such that a polymeric fiber tube is formed around rod 702. A tube/rod combination 706 thus exits polymer deposition zone. In some cases, a extruder can continually push rod 702 and tube/rod combination 706 along rollers 732 and 734. In some cases, rollers 732 and 734 can have a decline to allow gravity to assist movement of rod 702 through polymer deposition zone 712. In some cases, rollers 732 and 734 can have a helical ridges adapted to assist movement of rod 702 through polymer deposition zone 712.

Figure 7C:
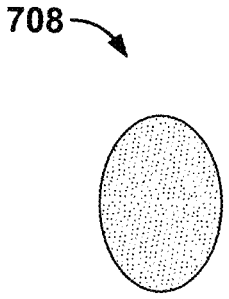
FIG. 7C depicts a potential product form for the apparatus of FIG. 7B.

A cutting device 770 can cut and seal the polymeric fiber tube in a single step. A variety of cutting devices can be used, which are discussed in greater detail below. FIG. 7B depicts an iris cutter. As the cutting and sealing device presses against the polymeric fiber tube, the polymeric tube can stretch and tobacco or similar material in covered rod 706 can flow, thus a reliable cross-seal of the polymeric fiber tube can be achieved. FIG. 7C depicts a potential product form 708 for the apparatus of FIG. 7B.

Figure 8:
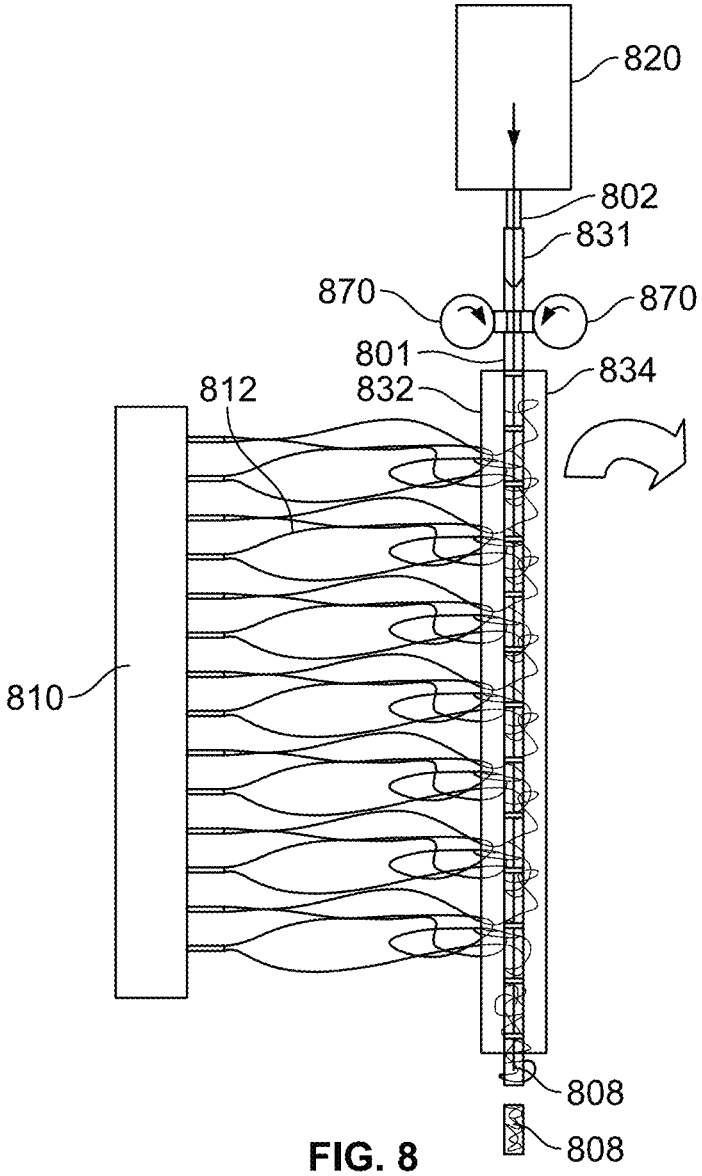
FIG. 8 depicts an exemplary apparatus for coating a dosing tube to create a tubular web and sealing a material into segments of the tubular web.

FIG. 8 depicts an apparatus similar to the apparatus in FIG. 7A, but that separates an extruded rod 802 into individual bodies 801 of smokeless tobacco or similar material before passing the individual bodies 801 through the polymer deposition zone 812 supported on rollers 832 and 834. As shown, extruder 820 can produce an extruded rod 802 that can pass into a supporting tube 831. Cutting wheel 870 can cut rod 802 into individual bodies 801 and provide spaces between adjacent bodies when the individual bodies 801 are supported by rollers 832 and 834 and pass through polymer deposition zone 812. Rollers 832 and 834 can rotate to rotate the individual bodies 801 as they pass through the polymer deposition zone. In addition to forming a tubular sleeve around each individual body, polymeric fibers can also adhere to upper and lower surfaces of each individual body due to spaces between individual bodies on the rollers 832 and 834, thus pouched individual bodies 808 can they exit the polymer deposition zone 812.

Figure 9:
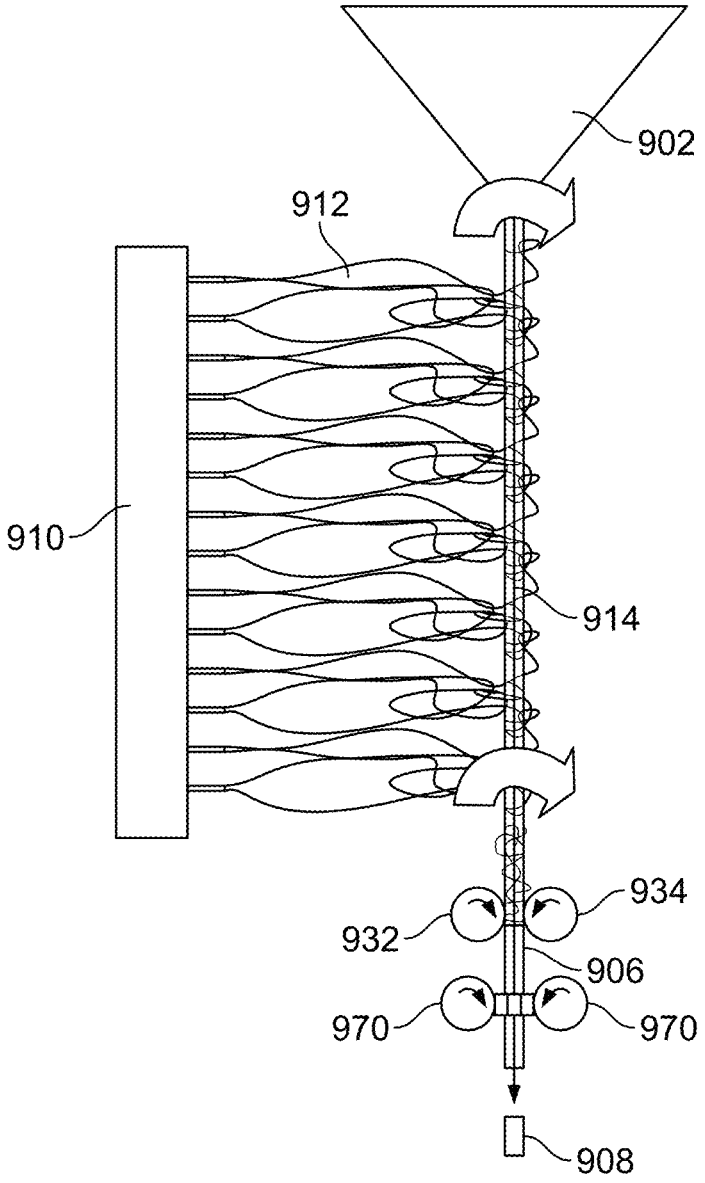
FIG. 9 depicts an exemplary apparatus for producing a pouched product by forming a tube of polymeric fibers on a dosing tube.

A tube of polymeric fibers can also be formed on a tube or mandrel and then used to pouch smokeless tobacco or a similar material therein. In some cases, a pouching machine can form a polymeric fiber tube on a dosing tube that can further provide a metered amount of tobacco for pouching in the polymeric fiber tube. FIG. 9 depicts an exemplary apparatus for producing a pouched product 908 by forming a tube of polymeric fibers on a rotating dosing tube 914 positioned in a polymer deposition zone 912 formed by a polymer spray head 910. Take away rollers 932 and 934 can pull a tube of polymeric fibers down and off dosing tube 914. A funnel or extruder 920 can deliver smokeless tobacco or similar material through dosing tube 914 and into a portion of tube 906 above a seal formed using cut and seal device 970. The material to be pouched can be in any suitable form, including loose fibrous material, compressed individual bodies of moist fibrous material, or an extruded rod of fibrous material. Cut and seal device 970 can intermittently cut and seal a continuously moving tube to form a plurality of pouched products as each cut and seal provides a top seal for a first pouched product 908 and a bottom seal for a subsequent pouched product 906. In some cases, take off rollers 932 and 934 can stretch the polymeric fiber tube to ensure a tight fit around the pouched material. Forming a polymer fiber tube over a dosing tube, such as dosing tube 914, can produce a consistent supply of non-woven material having uniform coverage. In some cases, dosing tube 914 can be positioned to catch at least 50%, at least 75%, at least 90%, at least 95%, or at least 99% of polymer fibers produced by polymer spray head 910, which can minimize waste resin. Dosing tube 914 can, in some cases, be cooled by a water spray, an internal chiller, by having a wet porous structure, or a combination thereof.

Figure 10A:
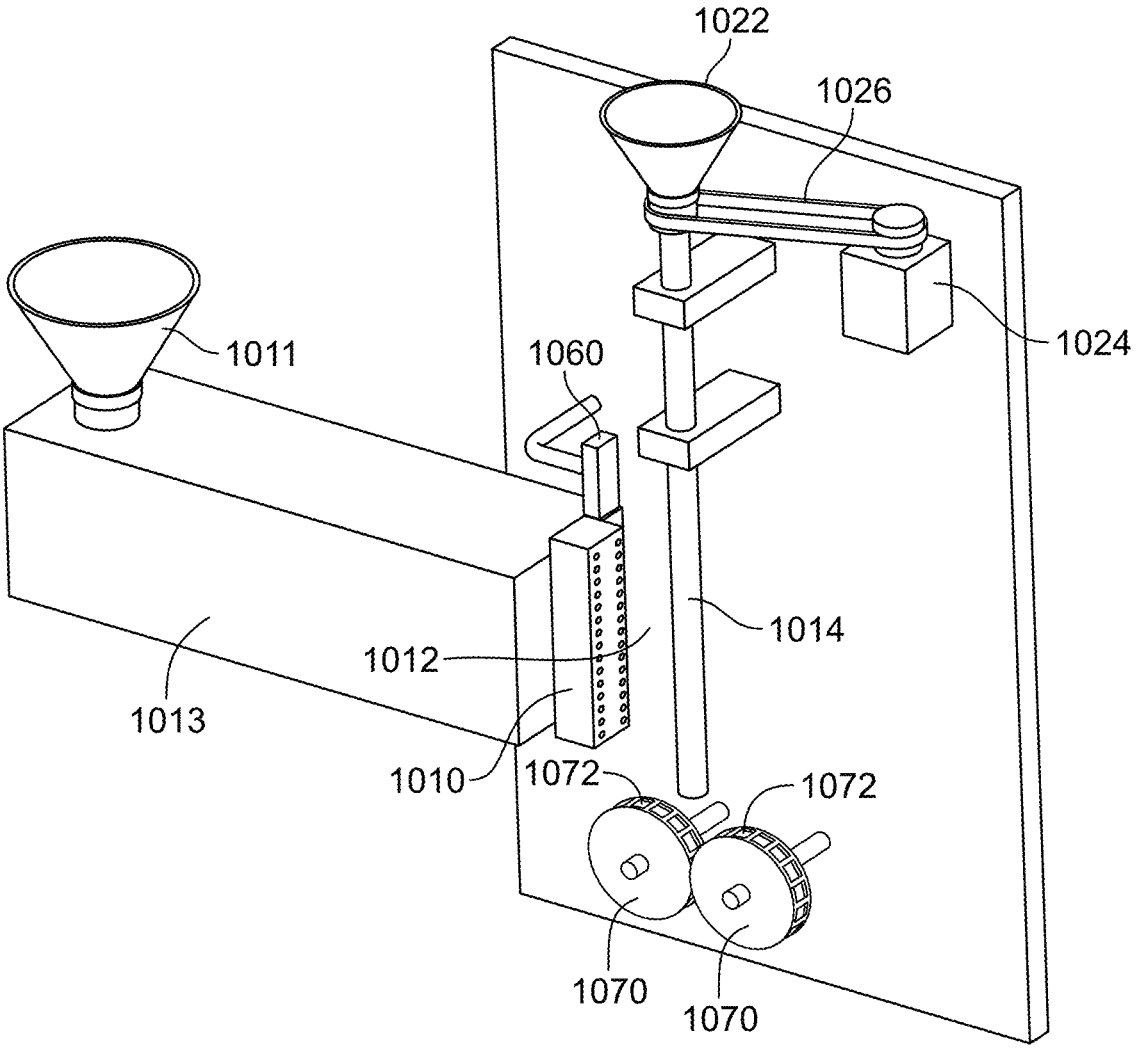
FIG. 10A depicts a second exemplary apparatus for producing a pouched product by forming a tube of polymeric fibers on a dosing tube.
Figure 10B:
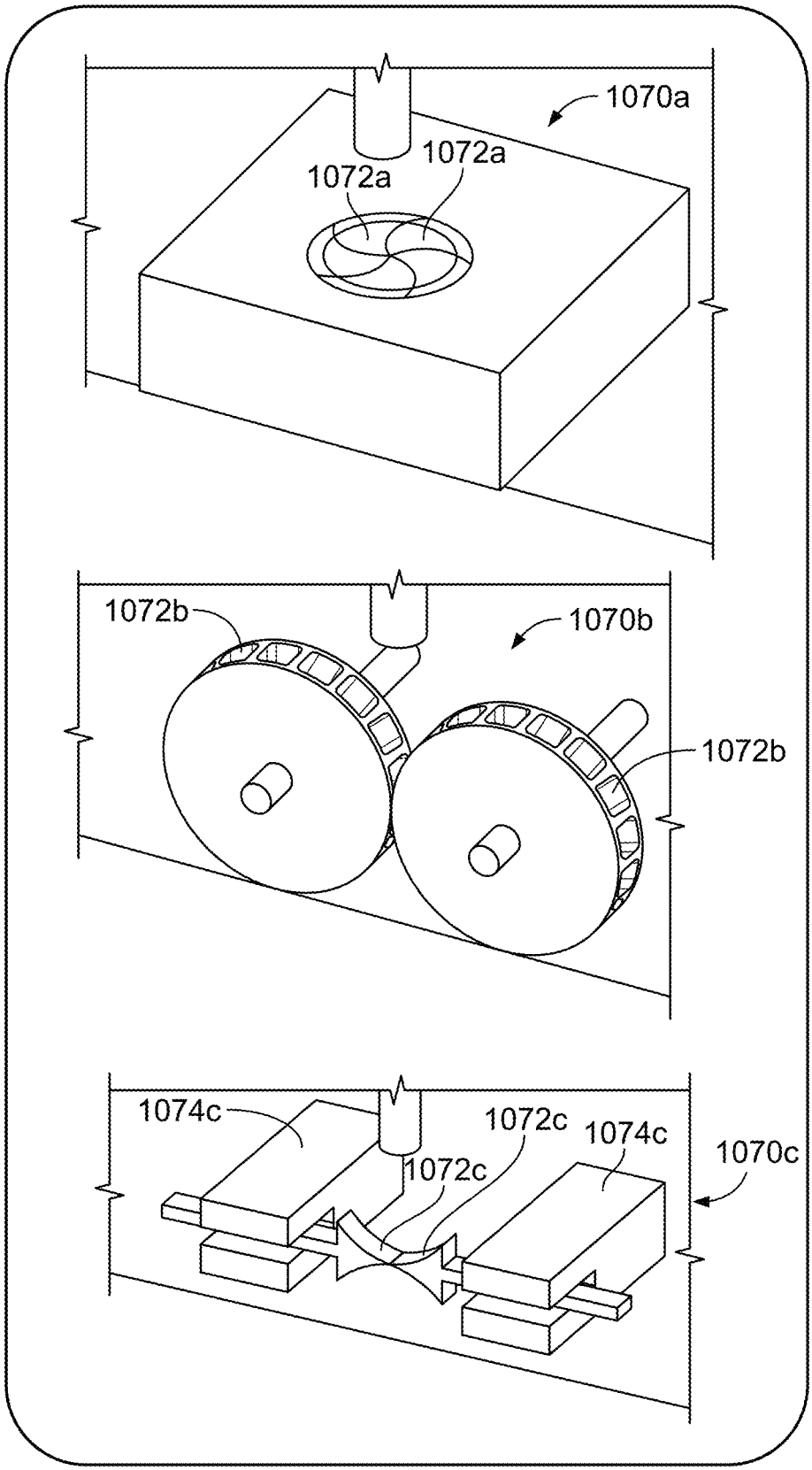
FIG. 10B depicts alternative cutting and/or sealing devices.
Figure 11A:
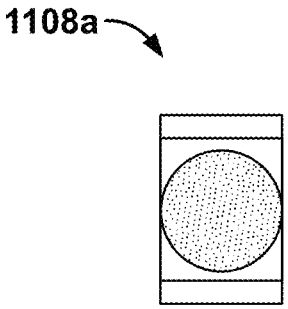
FIGS. 11A and 11B depict potential product forms for the apparatus of FIGS. 9 and 10A.
Figure 11B:
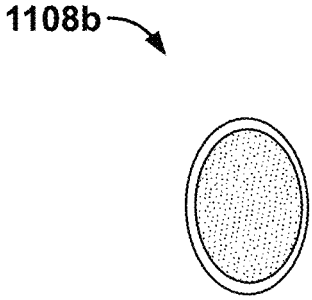

FIG. 10A depicts a second exemplary apparatus for producing a pouched product by forming a tube of polymeric fibers on a dosing tube 1014. As shown, polymer material can be introduced to a melt blowing device 1013 through port 1011 and melt blown through polymer spray head 1010 to produce a polymer deposition zone 1012 around dosing tube 1014 to produce a tube of melt-blown polymeric fibers on dosing tube 1014. Dispenser 1060 can provide an atomized mist of water, surfactant, flavorants, and/or sweeteners to quench polymeric fibers as they contact dosing tube 1014. A tube of polymeric fibers on dosing tube 1014 can be advanced downward and cut and sealed around deposits of smokeless tobacco or similar material by form and cut wheels 1070. Complementary recesses 1072 can produce top and bottom seals and cuts for a pouched product. Material to be pouched (e.g., smokeless tobacco material) can be introduced using funnel 1022 through dosing tube 1014, which can be rotated using motor 1024 and belt 1026. FIG. 10B depicts alternative cutting and sealing devices that can be used with any of the machines provided here. These devices are discussed in further detail below. FIGS. 11A and 11B depict potential product forms for the apparatus of FIGS. 9 and 10A. FIG. 11A depicts a loosely packed pouched product 1108*a*. FIG. 11B depicts a tightly packed pouched product 1108*b*.

Figure 12:
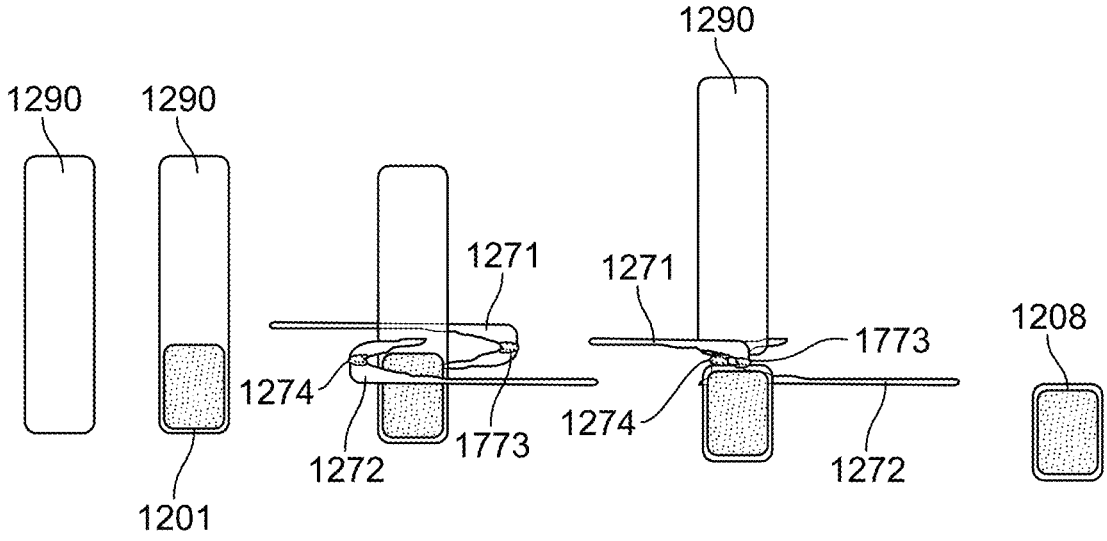
FIG. 12 depicts the use of hooks to seal and cut a tube.

FIG. 12 depicts the use of hooks to seal and cut a material placed in a sealed end of a tube 1290. As shown, polymer fiber tube 1290 is provided. In some cases, polymer fiber tube can be produced on a mandrel or dosing tube rotated through a polymer deposition zone. Loose or compacted material (e.g., smokeless tobacco material) can then be placed in tube 1290. In some cases, a metered amount of loose tobacco 1201 can be blown into tube 1290. Hooks 1271 and 1272 can be positioned around tube 1290 above tobacco 1201 or similar material and the hooks pulled in opposite directions to pinch off, seal, and cut a pouched product 1208. Hooks 1271 and 1271 can be ceramic with metal bases 1273 and 1274. When metal bases 1271 and 1273 contact, they can heat and cut polymeric fiber tube 1290. Ceramic hooks 1272 and 1274 can be used with the devices shown in FIGS. 7A, 7B, 8, 9, and 10A.

Folded Pouch Material

Methods and machines provided herein can, in some cases, form a coating of polymeric fibers on a substrate and wrap or fold the substrate around a deposit of tobacco and/or tobacco substitute to seal the tobacco or similar material in a non-woven polymeric-fiber sheet. In some cases, the substrate is folded around a deposit of tobacco and/or tobacco substitute. For example, the substrate can be paper. In some cases, a deposited coating on the substrate has a basis weight of 30 gsm or less. In some cases, a deposited coating on the substrate has a basis weight of 10 gsm or less. In some cases, the substrate can be an endless belt. For example, deposits of tobacco and/or tobacco substitute can be placed on a coating of polymeric fibers formed on an endless belt, and the endless belt can be bent up around the sides of the deposits to weld a longitudinal seal. Cross seals can additionally be made on both sides of each deposit, either before or after removing the substrate.

Figure 13:
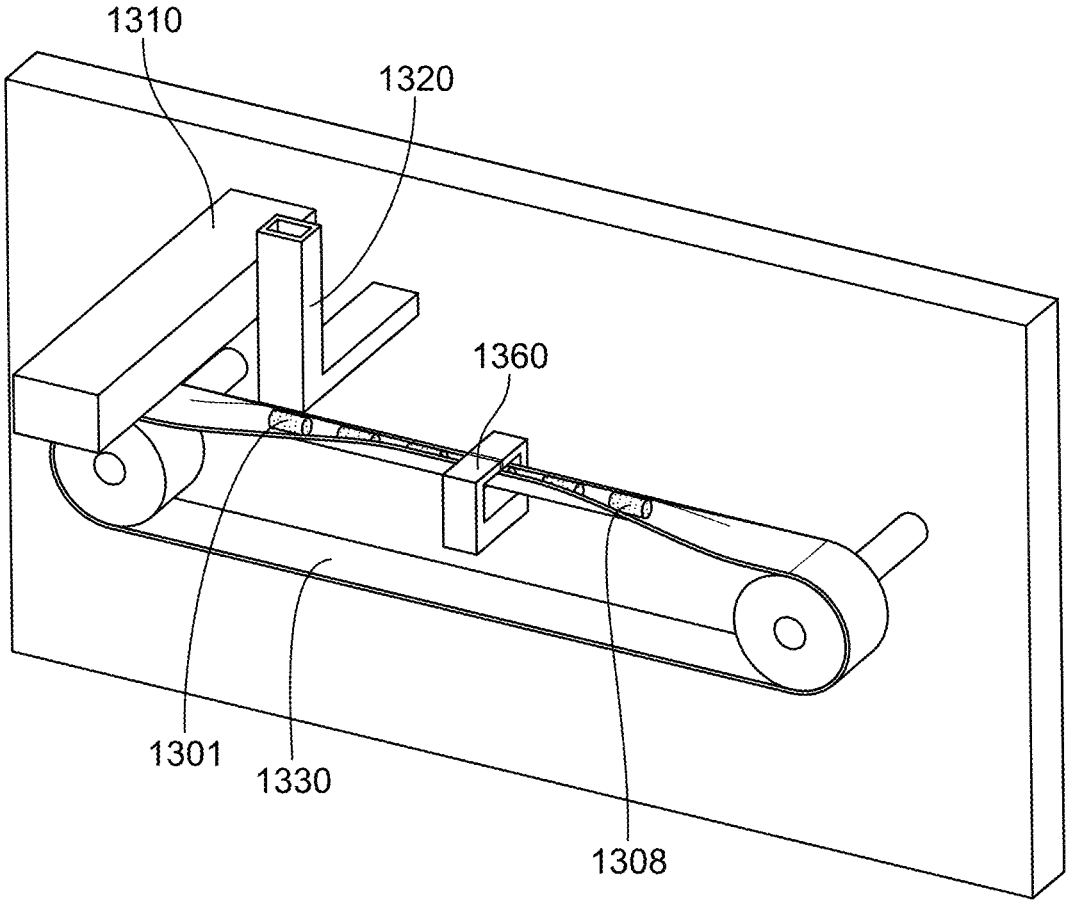
FIG. 13 depicts an exemplary apparatus for forming a pouch of a polymeric fiber web by applying polymer fibers to a substrate and wrapping the substrate around an individual body of smokeless tobacco or a similar material.
Figure 14A:
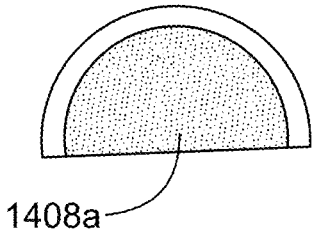
FIGS. 14A and 14B depict potential product forms for the apparatus of FIG. 13.
Figure 14B:
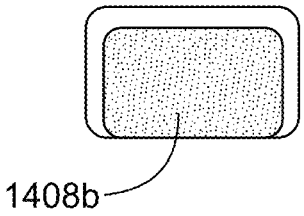

FIG. 13 depicts an exemplary apparatus for forming a pouch of a polymeric fiber web by applying polymer fibers to a substrate and wrapping the substrate around an individual body of smokeless tobacco or a similar material. As shown, a polymer spray head 1310 can deposit polymeric fibers onto endless belt 1330. A molding device 1320 can deposit smokeless tobacco 1301 or similar material on top of polymeric fibers deposited on endless belt 1330. Endless belt 1330 can then pass through a folding and sealing device 1360 adapted to fold the sides of endless belt up and around smokeless tobacco deposit 1301 and seal the sides around deposit 1301. In some cases, folding and sealing device 1360 or an additional device can create cross seals in front of and behind each deposit 1201 to produce pouched products 1308. FIGS. 14A and 14B depict potential product forms for the apparatus of FIG. 13.

Figure 15A:
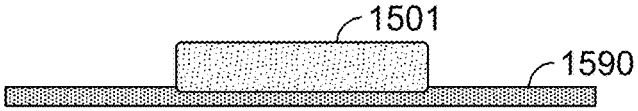
FIGS. 15A-15G depict how a web of polymeric fibers can be folded around an individual body of smokeless tobacco or a similar material.
Figure 15B:
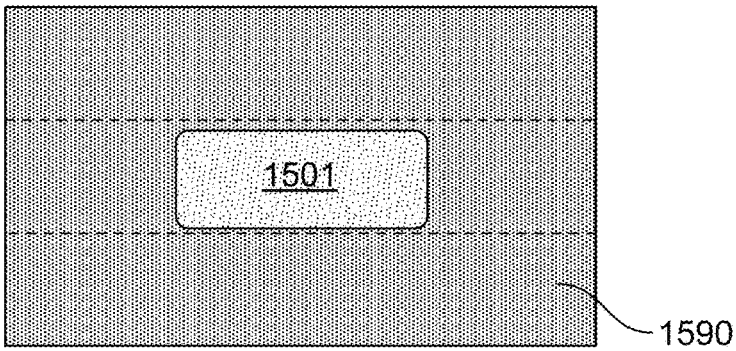
Figure 15C:
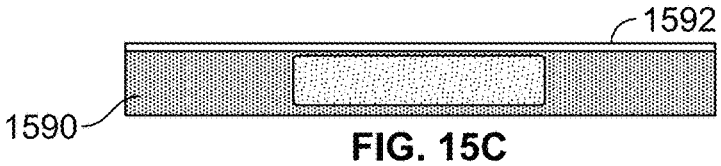
Figure 15D:
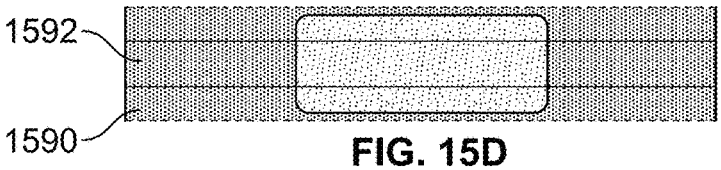
Figure 15E:
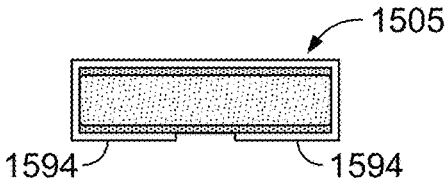
Figure 15F:
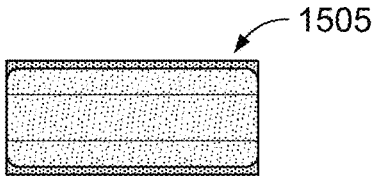
Figure 15G:
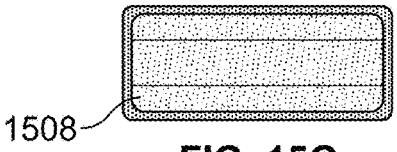

FIGS. 15A-15G depict how a web of polymeric fibers 1590 can be folded around an individual body 1501 of smokeless tobacco or a similar material to produce a pouched product 1508. A first fold along the dashed lines shown in FIG. 15B around body 1501 can yield a tubular wrapping having a seam 1592 on top as shown in FIGS. 15C and 15D. Edges 1594 can be folded down to produce a fully wrapped product 1505 as shown in FIGS. 15E and 15F. Heating fully wrapped product 1505 can melt bond polymer fibers to yield a pouched product 1508.

Cutting and Sealing Devices

Any suitable cutting and sealing device can be used in methods and machines provided here. FIG. 10B depicts an iris cutter 1070*a*, form and cut wheels 1070*b*, and crimp jaws 1070*c*. In some cases, hooks, such as those depicted in FIG. 12, can be used to cut and seal in methods and machines provided herein. Iris cutter 1070*a* can include multiple mechanically articulated elements 1072*a* that slide past each other in a radial fashion to produce a circle of decreasing diameter that closes to a point in the center. Elements 1072*a* can be blunt to produce a compressive force. Iris cutter 1070*a* can produce a circular pinched seal. Iris cutter 1070*a* can provide a rounded end on a pouched product with a very short seam at opposite tips of a pouch. When used to produce end seals in pouches formed in a tubular web of polymeric fibers, outer material tends in the tube tends to flow to the center without the polymer tube ripping or tearing as compressive forces within the forming pouch are substantially equal in all directions. Form and cut wheels 1070*b* can include corresponding recesses 1072*b* that can define the shape of a pouched product. As the wheels 1070*b* come together, polymeric fiber web(s) are pressed together, cut, and heat sealed along the periphery of each recess 1072*b*. Crimp jaws 1070*c* includes complementary crimp jaws 1072*c*, positioned with holders 1074*c*, which can produce clean cuts and seals.

Polymeric Fibers and Treatments

The fibers of webs provided herein can include any suitable polymer. Exemplary polymers include polypropylene, polyurethane, styrene, and/or combinations thereof. In some cases, polypropylene, polyurethane, and styrene can also be compounded together in different ratios to create a specific fiber. In some cases, polymers can be colored to provide a moist appearance and/or have hydrophilic properties that allow for wicking performance.

In some cases, the polymeric fibers include elastomeric polymers (e.g., polyurethane). Elastomeric polymers can provide webs with improved elongation and toughness. In some cases, an elastomeric polymer pouch provided herein can provide the unique property of allowing an adult tobacco consumer to reduce or increase a packing density of the elastomeric polymer pouch during use, which can impact a rate of flavor release. A higher packing density can reduce a rate of flavor release. In some cases, pouching materials used in methods and machines provided herein can be hydrophilic, which can provide a moist appearance and/or provide superior flavor release. Suitable elastomeric polymers include EPAMOULD (Epaflex), EPALINE (Epaflex), TEXIN (Bayer), DESMOPAN (Bayer), HYDROPHAN (AdvanceSourse Biomaterials), ESTANE (Lubrizol), PELLETHANE (Lubrizol), PEARLTHANE (Merquinsa), IROGRAN (Huntsman), ISOTHANE (Greco), ZYTHANE (Alliance Polymers and Services), VISTAMAX (ExxonMobil), TEXIN RXT70A (Bayer), and MD-6717 (Kraton). In some cases, elastomers can be combined with polyolefins at ratios ranging from 1:9 to 9:1. For example, elastomeric polymers can be combined with polypropylene.

In some cases, the polymeric fibers include thermoplastic materials (e.g., polyurethane), which can permit for thermal bonding at a seal without a need to include additional treatments at the seal location, such as applying chemical binders (e.g., ethyl vinyl acetate), which can impact flavor. A thermoplastic material can be heat sealed and cut in a single step to create a strong bonding region, avoiding the need to have a large heat seal area, which can cause mouth discomfort.

In some cases, the polymeric fibers are hydrophilic. For example, polyurethane is hydrophilic. Hydrophilic materials can wick fluids there through and/or give a pouched product a moist appearance.

Figure 16:
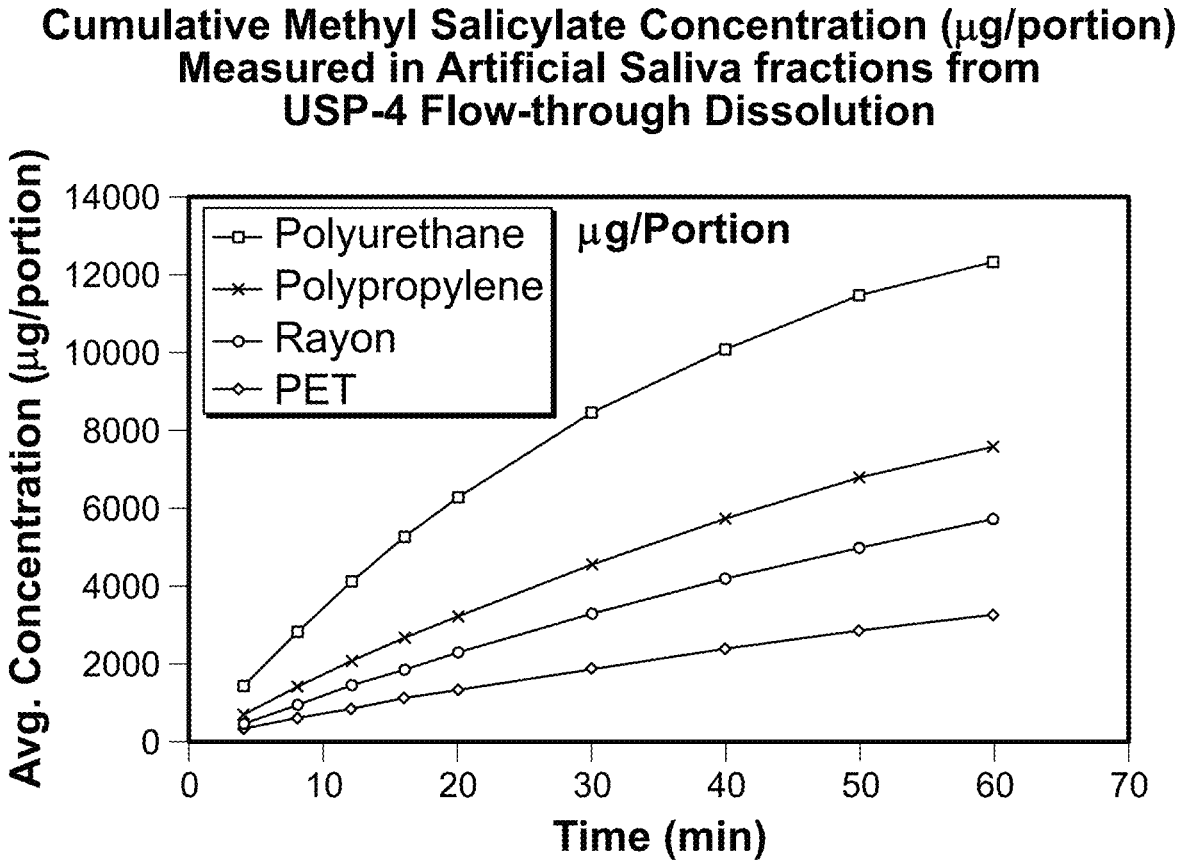
FIG. 16 depicts a chart comparing release rates of methyl sallylate from pouches made of different materials.

Polyurethane polymers can also provide faster and higher cumulative flavor release as compared to non-elastic polymer pouch substrates such as rayon, polypropylene, and polyethylene terephthalate (PET). FIG. 16 depicts the cumulative methyl sallcylate concentration (μg/portion) measured in artificial saliva fractions from USP-4 flow-through dissolution pouches made of polyurethane, polypropylene, rayon, and PET. Due to polyurethanes relatively high level of elasticity and natural hydrophilic properties, flavor is able to traverse polyurethane pouching material easier than non-elastomeric nonwoven substrates.

In some cases, the polymeric fibers are mouth-stable fibers. The mouth-stable fibers can have low extractables, have FDA food contact approval, and/or be manufactured by suppliers who are GMP approved. Highly desirable are materials that are easy to process and relatively easy to approve for oral use (e.g. quality, low extractables, has FDA food contact approval, suppliers are GMP approved).

Melt-blown fibers, electro spun, and centrifugally force spun fibers can be treated with a treatment fluid with a spray nozzle as the fibers exit the polymer spray heads discussed above. In some cases, the fibers can be treated downstream as part of a web or as a pouched product.

Atomized water can be used to cool the polymeric material. For example, atomized water can be directed into the stream of molten strands of polymeric material to "quench" the polymeric strands and form the fibers. For example, as depicted in FIG. 1A, a mist 113 can be aimed towards the spinnerets 111 of the melt-blowing polymer spray head 110. As discussed above in regards to FIG. 10A, a dispenser can be positioned to dispense atomized water, surfactant, flavorant, and/or sweetener into a polymer deposition zone. As depicted in FIG. 18B, a centrifugally force spinning spinneret can also provide a mist 1842 which can contact force-spun fibers as they exit orifices 1822. In some cases, a mist can be provide with air stream 1970 to quench the fibers 1930 formed in the apparatus depicted in FIG. 19. A fine mist of water vapor can quickly cool the strands below the polymer glass transition temperature. In some cases, quenched fibers can have improved softness and fiber/web tensile strength. In some cases, a surfactant is applied to the polymer fibers as they exit the spinnerets of a melt-blowing device or the orifices 1822 of a centrifugally force spinning spinneret 1820. In some cases, surfactant can be applied as a mist (either with or without water) as shown in FIG. 1A or FIG. 18B. In some cases, surfactant can be applied as a stream or a bath. In some cases, the surfactant applied as a mist 113 or 1842 can quench the polymer fibers. In some cases, a mixture of water and surfactant can be atomized and applied as mist. Sweeteners and/or flavorants can also be atomized and applied to the polymer fibers in a mist, which can also be used to quench the polymeric fibers.

Quenching the polymer can modify the crystallinity of the polymer material to improve tensile strength and mouth feel. The surfactant can improve the hydraulic permittivity of the web to improve moisture and flavor release. The hydraulic permittivity is the rate of fluid transfer through a substrate. Table 1 compares webs produced with and without surfactant treatment and water quenching. As shown in Table 1, melt-blown Sample 1 (produced without water quenching or a surfactant treatment) had a tensile integrity of 5.73 mJ and a permittivity of 8 seconds. Quenching with water (Sample 3) improved the tensile integrity to 7.09 mJ. Applying surfactant mixtures at different percentages also resulted in improved tensile integrity values (Samples 5-7). Added surfactant in amounts of 0.4% or greater (Samples 2, 6, and 7) reduced the permittivity to 6 seconds.

TABLE 1

Analytical Results Comparing Non-Treated & Surfactant Treated Melt Blown Material

| Analysis Results | 3962 PP Polymer | 3962 PP Polymer | 3962 PP Polymer | 3962 PP Polymer | 3962 PP Polymer | 3962 PP Polymer | 3962 PP Polymer |
|---|---|---|---|---|---|---|---|
| Sample # | 1 5-2-MB-001 PP3962 Standard MB Material | 2 5-2-MB-001 PP3963 LAB ADDED SURFACTANT | 3 5-2-MB-002 PP3962, Water Quenching, 3 g/m3 | 4 5-2-MB-002 PP3962, Water Quenching, 3 g/m4 LAB ADDED SURFACTANT | 5 5-2-MB-003 PP3962, Surfactant 0.2%, 3 g/m2 | 6 5-2-MB-004 PP3962, Surfactant 0.4%, 3 g/m2 | 7 5-2-MB-005 PP3962, Surfactant 0.6%, 3 g/m2. |
| Tensile Integrity (mJ) | 5.73 | | 7.09 | | 6.94 | 6.10 | 6.12 |
| Stdev | 0.89 | | 0.75 | | 0.85 | 1.19 | 0.67 |
| Permittivity (relative liquid flow through rate, s) | 8 | 6 | 7 | 6 | 8 | 6 | 6 |
| Stdev | 0.5 | 0.3 | 0.4 | 0.5 | 0.0 | 0.0 | 0.0 |
| Basis Weight (g/m2) | 3.0 | 3.0 | 3.0 | 3.0 | 3.0 | 3.0 | 3.0 |

The tensile integrity of the web can also be improved in a machine direction by provided fiber alignment along that machine direction. For example, the fibers produced by centrifugal force spinning that are substantially aligned. As will be discussed below, improved tensile integrity in a machine direction can allow the web to be pulled through a pouching machine to slit, form, and cut pouched products while still having a basis weight of less than 40 gsm, less than 30 gsm, less than 20 gsm, less than 10 gsm, less than 5 gsm, less than 3 gsm, or less than 2 gsm. In some cases, a web having a basis weight of about 3 gsm can have a tensile integrity in a machine direction of at least 6 mJ, at least 7 mJ, or at least 8 mJ. Tensile integrity of the web can also be improved by applying tension to the web when the web is in a heated tunnel or zone oven. By heating the polymer fibers to the glass transition temperature while under tension, the polymer fibers can be oriented in the direction of tension. The heating of the polymeric material to a temperature above its glass transition temperature can be accomplished by using electrically heated surfaces, ultrasonic bonding, infrared energy, radio frequency energy, microwave energy, laser, and/or needle punching. Needle punching, stitch bonding, point bonding, and quilting are methods of adding strength and/or applying patterns to nonwoven webs.

Bonding between the structural fibers can also be accomplished by incorporating a low melting temperature polymer into the network of structural fibers. The low melting temperature polymer could be introduced into the network in the form of fibers, beads, or random shapes. The low melting temperature polymer fibers, beads, or random shapes can be dispersed within the network of structural fibers. In some cases, the low melting temperature polymer has a melting point of between about 40° C. and 150° C. By heating the composite of the structural fibers, the smokeless tobacco, and the low melting temperature polymeric material to a temperature between the melting points of the two different materials (thus also above the glass transition temperature of the low melting temperature polymer), the low melting temperature polymeric material can be selectively melted and thus bond to surrounding fibers and also conform to at least portions of a surface topography of at least some of fibrous structures of tobacco. In some cases, the structural polymeric fibers are bicomponent or multicomponent fibers made of different materials.

Chemical bonding can also be used to further secure polymer fibers in webs. For example, adhesive materials in the form of beads or small random shapes, solvents, and/or solutions can be intermingled with the network of polymeric fibers and activated with heat and/or pressure to bond the network. In some cases, heat is used to both activate a chemical bonding agent and to bring the polymeric material above or below its glass transition temperature to conform the polymeric material to fibrous structures of tobacco. In some cases, silicone or polyvinyl acetate is used as a chemical adhesive. In some cases, sodium alginate is added to the network and then a calcium salt added to make the alginate insoluble within the network and thus bond surrounding fibers. Chemical bonding can be used with any other technique described herein.

The hydraulic permittivity of webs can also be increased by compounding the polymeric material with a filler prior to melt-blowing the polymeric material. In some cases, a colorant can be used as the filler. For example, a brown colorant can be added to a feed hopper of the extruder along with a polymer material (e.g., polypropylene) prior to melt blowing the polymer into the fibers. In addition to improving the hydraulic permittivity, the colorant can improve the aesthetic appeal of the pouched product 390. For example, a brown colorant can make a pouched moist-smokeless tobacco product appear moist. Table 2 below compares a melt-blown polypropylene polymer webs produced with and without brown colorant.

TABLE 2

| | Analysis Results | 3962 PP Polymer w/o Color | 3692 PP Polymer w/ Brown Color |
|---|---|---|---|
| | Sample # | 1 | 2 |
| Replicates | | 5-2-MB-001 PP3962, 3 g/m2 | 5-2-MB-006 PP3962, Techmer 8% 3.1 g/m2 |
| 6 | Tensile Integrity (mJ) | 5.73 | 7.19 |
| | Stdev | 0.89 | 1.23 |
| 15 | Permittivity (relative liquid flow through rate, s) | 8 | 3 |
| | Stdev | 0.5 | 0.4 |
| | Basis Weight (g/m2) | 3.0 | 3.1 |

As shown, the polypropylene having the brown colorant (Techmer) had an increased tensile integrity and a permittivity. The colorant and the polymer can be compounded and pelletized prior to melt-blowing the polymer to ensure a consistent ratio of colorant to polymer.

Suitable polymeric materials include one or more of the following polymer materials: acetals, acrylics such as polymethylmethacrylate and polyacrylonitrile, alkyds, polymer alloys, allyls such as diallyl phthalate and diallyl isophthalate, amines such as urea, formaldehyde, and melamine formaldehyde, epoxy, cellulosics such as cellulose acetate, cellulose triacetate, cellulose nitrate, ethyl cellulose, cellulose acetate, propionate, cellulose acetate butyrate, hydroxypropyl cellulose, methyl hydroxypropyl cellulose (CMC), HPMC, carboxymethyl cellulose, cellophane and rayon, chlorinated polyether, coumarone-indene, epoxy, polybutenes, fluorocarbons such as PTFE, FEP, PFA, PCTFE, ECTFE, ETFE, PVDF, and PVF, furan, hydrocarbon resins, nitrile resins, polyaryl ether, polyaryl sulfone, phenol-aralkyl, phenolic, polyamide (nylon), poly (amide-imide), polyaryl ether, polycarbonate, polyesters such as aromatic polyesters, thermoplastic polyester, PBT, PTMT, (polyethylene terephthalate) PET and unsaturated polyesters such as SMC and BMC, thermoplastic polyimide, polymethyl pentene, polyolefins such as LDPE, LLDPE, HDPE, and UHMWPE, polypropylene, ionomers such as PD and poly allomers, polyphenylene oxide, polyphenylene sulfide, polyurethanes (such as DESMOPAN DP 9370A available from Bayer), poly p-xylylene, silicones such as silicone fluids and elastomers, rigid silicones, styrenes such as PS, ADS, SAN, styrene butadiene latricies, and styrene based polymers, suflones such as polysulfone, polyether sulfone and polyphenyl sulfones, polymeric elastomers, and vinyls such as PVC, polyvinyl acetate, polyvinylidene chloride, polyvinyl alcohol, polyvinyl butyrate, polyvinyl formal, propylene-vinyl chloride copolymer, EVA (ethyl vinyl acetate), and polyvinyl carbazole, polyvinyl pyrrolidone, and polyethylene oxide, and ethylene vinyl alcohol.

The polymeric material can include multiple materials. In some cases, fibers of a first polymeric material are interspersed or layered with fibers of a second polymeric material. For example, a lower melting polymer can function as a binder which may be a separate fiber interspersed with higher melting structural polymer fibers. In some cases, structural fibers can include multiple components made of different materials. For example, a lower melting sheath can surround a higher melting core, which can help with the conforming and/or bonding processes. The components of a multi-component fiber can also be extruded in a side-by-side configuration. For example, different polymeric materials can be co-extruded and drawn in a melt-blowing or force spun to form the multi-component structural fibers.

In some cases, the polymeric material includes one mouth-stable material and one mouth-dissolvable material such that the smokeless tobacco product will loosen but remain cohesive as the mouth-dissolvable material dissolves away. In some cases, a network of structural polymeric fibers includes mouth-dissolvable polymeric fibers and mouth-stable polymeric fibers. As used herein, "mouth-stable" means that the material remains cohesive when placed in a mouth of an adult tobacco consumer for 1 hour. As used herein, "mouth-dissolvable" means that the material breaks down within 1 hour after being exposed to saliva and other mouth fluids when placed in an adult tobacco consumer's mouth. Mouth-dissolvable materials include hydroxypropyl cellulose (HPC), methyl hydroxypropyl cellulose (HPMC), polyvinyl alcohol (PVOH), PVP, polyethylene oxide (PEO), starch and others. Mouth-dissolvable materials could be combined with flavors, sweeteners, milled tobacco and other functional ingredients. In other embodiments, multi-component fibers include a mouth-stable material and a mouth-dissolvable material.

In some cases, the polymeric material includes reconstituted cellulosic fibers. Reconstituted cellulosic fibers can be created from various woods and annual plants by physically dissolving the wood or plant material in a suitable solvent, such as methylmorpholine oxide (MNNO) monohydrate. The concentration of cellulose in the solution can be between 6 weight and 15 weight percent. The solution can then be spun (e.g., melt-blown or centrifugally force spun) at a temperature of between 40° C. and 150° C. to create reconstituted cellulosic fibers. In some cases, the reconstituted cellulosic fibers are made using tobacco material (e.g., tobacco stems). Reconstituted tobacco cellulosic fibers can then be intermingled with smokeless tobacco having natural cellulosic fibers to create a pouched tobacco product having tobacco-derived structural fibers. The reconstituting process changes the composition of the tobacco and removes soluble tobacco components.

The polymeric material can also be combined with milled tobacco prior to contacting the tobacco with the smokeless tobacco. For example, milled tobacco could be combined into a polymeric structural fiber such that the polymeric material at least partially encapsulates the milled tobacco. For example, milled tobacco could be added to a molten polymer (e.g., polypropylene) in amounts of up to about 80% and extruded in a melt-blowing or spun bond process. The milled tobacco can provide a unique texture while the polymeric material remains mouth-stable and cohesive.

The amount of polymeric material used in the pouched tobacco product depends on the desired flavor profile and desired mouth feel. In some cases, the pouched tobacco product includes between 0.1 and 10 weight percent polymeric material, which can increase the likelihood that the pouched tobacco product maintains its integrity during packaging and transport. In some cases, pouched products produced in methods and/or machines provided herein can be rewet with water and/or a solution of flavorants, sweeteners, and/or other additives discussed herein to wick the coating of polymeric fibers, provide a moist appearance, prove a flavor immediately, and/or to increase a flavor intensity.

Tobacco

Smokeless tobacco is tobacco suitable for use in an orally used tobacco product. By "smokeless tobacco" it is meant a part, e.g., leaves, and stems, of a member of the genus *Nicotiana* that has been processed. Exemplary species of tobacco include *N. rustica, N. tabacum, N. tomentosiformis*, and *N. sylvestris*. Suitable tobaccos include fermented and unfermented tobaccos. In addition to fermentation, the tobacco can also be processed using other techniques. For example, tobacco can be processed by heat treatment (e.g., cooking, toasting), flavoring, enzyme treatment, expansion and/or curing. Both fermented and non-fermented tobaccos can be processed using these techniques. In other embodiments, the tobacco can be unprocessed tobacco. Specific examples of suitable processed tobaccos include, dark air-cured, dark fire-cured, burley, flue cured, and cigar filler or wrapper, as well as the products from the whole leaf stemming operation. In some cases, smokeless tobacco includes up to 70% dark tobacco on a fresh weight basis. For example, tobacco can be conditioned by heating, sweating and/or pasteurizing steps as described in U.S. Publication Nos. 2004/0118422 or 2005/0178398. In addition to modifying the aroma of the leaf, fermentation can change the color, texture, and other sensorial attributes (taste) of a leaf. Also during the fermentation process, evolution gases can be produced, oxygen can be taken up, the pH can change, and the amount of water retained can change. See, for example, U.S. Publication No. 2005/0178398 and Tso (1999, Chapter 1 in Tobacco, Production, Chemistry and Technology, Davis & Nielsen, eds., Blackwell Publishing, Oxford). Cured, or cured and fermented tobacco can be further processed (e.g., cut, expanded, blended, milled or comminuted) prior to incorporation into the smokeless tobacco product. The tobacco, in some cases, is long cut fermented cured moist tobacco having an oven volatiles content of between 30 and 61 weight percent prior to mixing with the polymeric material and optionally flavorants and other additives.

The tobacco can, in some cases, be prepared from plants having less than 20 μg of DVT per $cm^2$ of green leaf tissue. For example, the tobacco particles can be selected from the tobaccos described in U.S. Patent Publication No. 2008/0209586, which is hereby incorporated by reference. Tobacco compositions containing tobacco from such low-DVT varieties exhibits improved flavor characteristics in sensory panel evaluations when compared to tobacco or tobacco compositions that do not have reduced levels of DVTs.

Green leaf tobacco can be cured using conventional means, e.g., flue-cured, barn-cured, fire-cured, air-cured or sun-cured. See, for example, Tso (1999, Chapter 1 in Tobacco, Production, Chemistry and Technology, Davis & Nielsen, eds., Blackwell Publishing, Oxford) for a description of different types of curing methods. Cured tobacco is usually aged in a wooden drum (i.e., a hogshead) or cardboard cartons in compressed conditions for several years (e.g., two to five years), at a moisture content ranging from 10% to about 25%. See, U.S. Pat. Nos. 4,516,590 and 5,372,149. Cured and aged tobacco then can be further processed. Further processing includes conditioning the tobacco under vacuum with or without the introduction of steam at various temperatures, pasteurization, and fermentation. Cure, aged, and fermented smokeless tobacco can be further processed (e.g., cut, shredded, expanded, or blended). See, for example, U.S. Pat. Nos. 4,528,993; 4,660,577; and 4,987,907.

The smokeless tobacco can be processed to a desired size. For example, long cut smokeless tobacco typically is cut or shredded into widths of about 10 cuts/inch up to about 110 cuts/inch and lengths of about 0.1 inches up to about 1 inch. Double cut smokeless tobacco can have a range of particle sizes such that about 70% of the double cut smokeless tobacco falls between the mesh sizes of −20 mesh and 80 mesh. Other lengths and size distributions are also contemplated.

The smokeless tobacco can have a total oven volatiles content of about 10% by weight or greater; about 20% by weight or greater; about 40% by weight or greater; about 15% by weight to about 25% by weight; about 20% by weight to about 30% by weight; about 30% by weight to about 50% by weight; about 45% by weight to about 65% by weight; or about 50% by weight to about 60% by weight. Those of skill in the art will appreciate that "moist" smokeless tobacco typically refers to tobacco that has an oven volatiles content of between about 30% by weight and about 61% by weight (e.g., about 45% by weight to about 55% by weight, or about 50% by weight). As used herein, "oven volatiles" are determined by calculating the percentage of weight loss for a sample after drying the sample in a pre-warmed forced draft oven at 110° C. for 3.25 hours. The pouched tobacco product can have a different overall oven volatiles content than the oven volatiles content of the smokeless tobacco used to make the pouched tobacco product. The processing steps described herein can reduce or increase the oven volatiles content. The overall oven volatiles content of the pouched tobacco product is discussed below.

The pouched tobacco product can include between 15 weight percent and 85 weight percent smokeless tobacco on a dry weight basis. The amount of smokeless tobacco in a pouched tobacco product on a dry weight basis is calculated after drying the pouched tobacco product in a pre-warmed forced draft oven at 110° C. for 3.25 hours. The remaining non-volatile material is then separated into tobacco material and polymeric material. The percent smokeless tobacco in the pouched tobacco product is calculated as the weight smokeless tobacco divided by the total weight of the non-volatile materials. In some cases, the pouched tobacco product includes between 20 and 60 weight percent tobacco on a dry weight basis. In some cases, the pouched tobacco product includes at least 28 weight percent tobacco on a dry weight basis.

In some cases, a plant material other than tobacco is used as a tobacco substitute in the pouched products made using machines and methods provided herein. The tobacco substitute can be an herbal composition. Herbs and other edible plants can be categorized generally as culinary herbs (e.g., thyme, lavender, rosemary, coriander, dill, mint, peppermint) and medicinal herbs (e.g., Dahlias, Cinchona, Foxglove, Meadowsweet, Echinacea, Elderberry, Willow bark). In some cases, the tobacco is replaced with a mixture of non-tobacco plant material. Such non-tobacco compositions may have a number of different primary ingredients, including but not limited to, tea leaves, red clover, coconut flakes, mint leaves, ginseng, apple, corn silk, grape leaf, and basil leaf. The plant material typically has a total oven volatiles content of about 10% by weight or greater; e.g., about 20% by weight or greater; about 40% by weight or greater; about 15% by weight to about 25% by weight; about 20% by weight to about 30% by weight; about 30% by weight to about 50% by weight; about 45% by weight to about 65% by weight; or about 50% by weight to about 60% by weight.

Flavorants and Additives

Flavors and other additives can be included in the compositions and arrangements described herein and can be added to the pouched tobacco product at any point in the process. For example, any of the initial components, including the polymeric material, can be provided in a flavored form. In some cases, flavorants and/or other additives are included in the smokeless tobacco. In some cases, flavorants and/or other additives are absorbed into to the pouched tobacco product after pouching. In some cases, flavorants and/or other additives are mixed with the polymeric material (e.g., with structural fibers) prior to melt-blowing the fibers and/or as the fibers exit the spinnerets.

Suitable flavorants include wintergreen, cherry and berry type flavorants, various liqueurs and liquors such as Drambuie, bourbon, scotch, whiskey, spearmint, peppermint, lavender, cinnamon, cardamom, apium graveolents, clove, cascarilla, nutmeg, sandalwood, bergamot, geranium, honey essence, rose oil, vanilla, lemon oil, orange oil, Japanese mint, cassia, caraway, cognac, jasmine, chamomile, menthol, ilangilang, sage, fennel, piment, ginger, anise, coriander, coffee, liquorish, and mint oils from a species of the genus *Mentha*. Mint oils useful in particular embodiments of the pouched tobacco products include spearmint and peppermint.

Flavorants can also be included in the form of flavor beads, which can be dispersed within the pouched tobacco product (e.g., in a nonwoven network of polymeric structural fibers). For example, the pouched tobacco product could include the beads described in U.S. Patent Application Publication 2010/0170522, which is hereby incorporated by reference.

In some cases, the amount of flavorants in the pouched tobacco product is limited to less than 30 weight percent in sum. In some cases, the amount of flavorants in the pouched tobacco product can be limited to be less than 5 weight percent in sum. For example, certain flavorants can be included in the pouched tobacco product in amounts of about 3 weight percent.

Other optional additives can include but are not limited to fillers (e.g., starch, di-calcium phosphate, lactose, sorbitol, mannitol, and microcrystalline cellulose), soluble fiber (e.g., Fibersol from Matsushita), calcium carbonate, dicalcium phosphate, calcium sulfate, and clays), sodium chloride, lubricants (e.g., lecithin, stearic acid, hydrogenated vegetable oil, mineral oil, polyethylene glycol 4000-6000 (PEG), sodium lauryl sulfate (SLS), glyceryl palmitostearate, sodium benzoate, sodium stearyl fumarate, talc, and stearates (e.g., Mg or K), and waxes (e.g., glycerol monostearate, propylene glycol monostearate, and acetylated monoglycerides)), plasticizers (e.g., glycerine, propylene glycol, polyethylene glycol, sorbitol, mannitol, triacetin, and 1,3 butane diol), stabilizers (e.g., ascorbic acid and monosterol citrate, BHT, or BHA), artificial sweeteners (e.g., sucralose, saccharin, and aspartame), disintegrating agents (e.g., starch, sodium starch glycolate, cross caramellose, cross linked PVP), pH stabilizers, or other compounds (e.g., vegetable oils, surfactants, and preservatives). Some compounds display functional attributes that fall into more than one of these categories. For example, propylene glycol can act as both a plasticizer and a lubricant and sorbitol can act as both a filler and a plasticizer.

Oven volatiles, such as water, may also be added to the pouched tobacco product to bring the oven volatiles content of the pouched tobacco product into a desired range. In some cases, flavorants and other additives are included in a hydrating liquid.

Oven Volatiles

The pouched tobacco product can have a total oven volatiles content of between 10 and 61 weight percent. In some cases, the total oven volatiles content is at least 40 weight percent. The oven volatiles include water and other volatile compounds, which can be a part of the tobacco, the polymeric material, the flavorants, and/or other additives. As used herein, the "oven volatiles" are determined by calculating the percentage of weight loss for a sample after drying the sample in a pre-warmed forced draft oven at 110° C. for 3.25 hours. Some of the processes may reduce the oven volatiles content (e.g., heating the composite or contacting the smokeless tobacco with a heated polymeric material), but the processes can be controlled to have an overall oven volatiles content in a desired range. For example, water and/or other volatiles can be added back to the pouched tobacco product to bring the oven volatiles content into a desired range. In some cases, the oven volatiles content of the composite pouched tobacco product 390 is between 50 and 61 weight percent. For example, the oven volatiles content of smokeless tobacco used in the various processed described herein can be about 57 weight percent. In other embodiments, the oven volatiles content can be between 10 and 30 weight percent.

Other Embodiments

It is to be understood that, while the invention has been described herein in conjunction with a number of different aspects, the foregoing description of the various aspects is intended to illustrate and not limit the scope of the invention, which is defined by the scope of the appended claims. Other aspects, advantages, and modifications are within the scope of the following claims.

Disclosed are methods and compositions that can be used for, can be used in conjunction with, can be used in preparation for, or are products of the disclosed methods and compositions. These and other materials are disclosed herein, and it is understood that combinations, subsets, interactions, groups, etc. of these methods and compositions are disclosed. That is, while specific reference to each various individual and collective combinations and permutations of these compositions and methods may not be explicitly disclosed, each is specifically contemplated and described herein. For example, if a particular composition of matter or a particular method is disclosed and discussed and a number of compositions or methods are discussed, each and every combination and permutation of the compositions and the methods are specifically contemplated unless specifically indicated to the contrary. Likewise, any subset or combination of these is also specifically contemplated and disclosed.

What is claimed is:

1. A method of making an oral product comprising:

providing a product portion between a first nonwoven fabric and a second nonwoven fabric;

sealing the first nonwoven fabric to the second nonwoven fabric using a seal cutter roller, the seal cutter roller defining a recess configured to align with the product portion; and concurrently with the sealing, cutting the first nonwoven fabric and the second nonwoven fabric around a periphery of the product portion to form the oral product.

2. The method of claim 1, wherein the sealing is performed using ultrasonic energy.

3. The method of claim 1, wherein the providing comprises:

applying the first nonwoven fabric to a surface, depositing the product portion on the first nonwoven fabric, and applying the second nonwoven fabric over the product portion.

4. The method of claim 3, wherein the providing further includes conforming the first nonwoven fabric to the surface prior to the depositing.

5. The method of claim 4, wherein the conforming includes applying vacuum to the first nonwoven fabric.

6. The method of claim 3, wherein the providing further includes moving the surface.

7. The method of claim 6, wherein the moving is performed during the applying the first nonwoven fabric, the depositing, and the applying the second nonwoven fabric.

8. The method of claim 6, wherein the surface is a surface of a conveyor.

9. The method of claim 6, wherein the surface is a surface of a rotating drum.

10. The method of claim 3, wherein the applying the first nonwoven fabric includes supplying the first nonwoven fabric with a supply roller.

11. The method of claim 3, wherein the depositing includes aligning the product portion with a recess in the surface, the recess in the surface configured to be aligned with the recess of the seal cutter roller.

12. The method of claim 3, wherein the applying the second nonwoven fabric includes supplying the second nonwoven fabric with a supply roller.

13. The method of claim 1, wherein the first nonwoven fabric and the second nonwoven fabric each have a basis weight of less than or equal to 30 grams per square meter.

14. The method of claim 1, wherein the first nonwoven fabric and the second nonwoven fabric each include elastomeric materials.

15. The method of claim 1, wherein the first nonwoven fabric and the second nonwoven fabric each include polyurethane.

16. The method of claim 1, wherein the product portion is a molded product portion.

17. The method of claim 1, wherein the product portion is a loose product portion.

18. The method of claim 1, wherein the oral product includes nicotine.

19. The method of claim 18, wherein the nicotine is a tobacco extract.

* * * * *